US012662340B2

(12) United States Patent
Kalany et al.

(10) Patent No.: US 12,662,340 B2
(45) Date of Patent: Jun. 23, 2026

(54) ROTARY CARTON FEEDER

(71) Applicant: R.A Jones & Co., Covington, KY (US)

(72) Inventors: Robert M. Kalany, Florence, KY (US); Andrew James Nelson, Davenport, IA (US); Robert Todd Gatman, Burlington, KY (US)

(73) Assignee: R.A Jones & Co., Covington, KY (US)

( * ) Notice: Subject to any disclaimer, the term of this patent is extended or adjusted under 35 U.S.C. 154(b) by 1178 days.

(21) Appl. No.: 17/608,545

(22) PCT Filed: Aug. 12, 2021

(86) PCT No.: PCT/US2021/045755

§ 371 (c)(1),
(2) Date: Feb. 16, 2023

(87) PCT Pub. No.: WO2023/018416

PCT Pub. Date: Feb. 16, 2023

(65) Prior Publication Data

US 2024/0034579 A1 Feb. 1, 2024

(51) Int. Cl.
*B65H 3/42* (2006.01)
*B65H 3/08* (2006.01)

(52) U.S. Cl.
CPC ..... *B65H 3/42* (2013.01); *B65H 3/0883* (2013.01); *B65H 2403/481* (2013.01);
(Continued)

(58) Field of Classification Search
CPC .. B65H 3/42; B65H 3/0808; B65H 2403/543; B65H 2403/481; B31B 50/804;
(Continued)

(56) References Cited

U.S. PATENT DOCUMENTS 4,518,301 A 5/1985 Greenwell
4,537,587 A 8/1985 Langen
(Continued)

FOREIGN PATENT DOCUMENTS

DE 4231993 A1 12/1993
EP 0132617 A1 2/1985

OTHER PUBLICATIONS

The International Bureau of WIPO, International Preliminary Report On Patentability, International Application No. PCT/US2021/045755, mailed Feb. 22, 2024 (19 pages).
(Continued)

*Primary Examiner* — Luis A Gonzalez
(74) *Attorney, Agent, or Firm* — Wood Herron & Evans LLP

(57) ABSTRACT

A rotary carton feeder includes a planetary drive having two sun rings with angular phase, cam surfaces on each ring about a common axis. Planetary members rotate about the common axis with a number of said planet members in operative engagement with one of the cams and another number of planet members in operative engagement with a second one of said sun rings. Spindles are selectively combined with selected planet members to selectively accommodate handling variably sized cartons of 1, 2, 3 or 4 count. Suction cups on spindle ends traverse an enclosed path having four cusps. Variations are disclosed.

53 Claims, 26 Drawing Sheets

(52) U.S. Cl.
CPC .. *B65H 2403/543* (2013.01); *B65H 2406/345* (2013.01); *B65H 2701/1764* (2013.01)

(58) Field of Classification Search
CPC ... B31B 50/062; B65B 43/185; B65B 43/305; B65G 47/915; B65G 47/918; B65G 47/848
See application file for complete search history.

(56) References Cited

U.S. PATENT DOCUMENTS

| | | | | |
|---|---|---|---|---|
| 4,601,691 | A | 7/1986 | Greenwell | |
| 4,871,348 | A | 10/1989 | Konaka | |
| 5,775,062 | A | 7/1998 | Ghini et al. | |
| 5,910,078 | A | 6/1999 | Guttinger et al. | |
| 5,992,458 | A | 11/1999 | Novacek et al. | |
| 7,081,079 | B2 | 7/2006 | Baclija et al. | |
| 2012/0067004 | A1* | 3/2012 | Kalany | B65B 43/285 53/381.1 |

OTHER PUBLICATIONS

European Patent Office, International Search Report and Written Opinion of the International Searching Authority, International Application No. PCT/US2021/045755, mailed May 24, 2022 (24 pages).

* cited by examiner

ROTARY CARTON FEEDER

CROSS-REFERENCE TO RELATED APPLICATION

The present application is a U.S. National Stage entry under 35 U.S.C. § 371 of, and claims priority to, International Application No. PCT/US2021/045755, filed Aug. 12, 2021, the disclosure of which is hereby incorporated herein by reference in its entirety.

FIELD OF THE INVENTION

This invention relates to apparatus and methods for feeding items from a supply to another position, including feeding carton blanks from one position at a magazine discharge to another position. More particularly, this invention relates to feeding carton blanks from a pick station proximate a carton magazine to a place station, such as on a moving carton conveyor associated with a cartoning apparatus.

Even more particularly, this invention relates to the rotary feeding of carton blanks from a carton magazine to a cartoning apparatus and capable of feeding carton blanks of a wide variety of sizes.

While the invention is particularly useful in feeding cartoners, the invention can be applied to other uses where articles must be transferred from station to station.

BACKGROUND OF THE INVENTION

The cartoning industry has known of the rotary or orbital feeding of carton blanks for some time.

An example of such an orbital feeder is described in Applicant's own prior U.S. Pat. No. 4,518,301 to Greenwell, which is expressly and fully incorporated by reference herein. Additional disclosures of rotary feeding are, to name a few: U.S. Pat. Nos. 4,537,587; 4,601,691; 4,871,348; 5,910,078; 5,992,458; and 7,081,079, each of which is herewith incorporated herein by this reference.

Among other things, these patents disclose rotary carton feeders having a single cam ring, referred to as a sun ring or sun gear, a plurality of rotatable planetary members mounted about a common axis of the sun gear, moveable in a circular path about the common axis and rotated on their own secondary axes by the sun gear when they move in the circular path about the common axis. Spindles or "moon" members are mounted on each planetary member and each spindle or moon includes or incorporates one or more vacuum operated suction cups for engaging and holding a carton blank thereon, and through a path.

When the planet members revolve around the sun ring or common axis, the members also respectively rotate, thus rotating the spindles, all by the action of the motion of the planetary members engaging the sun ring as they move in a circular path about the common axis.

According to the Greenwell U.S. Pat. No. 4,518,301, such feeders employ a modification of a conventional hypocycloidal motion, when suction cups carried by spindles as part of the rotating planetary elements rotate at non-uniform speeds during each revolution of the feeder, the non-uniform speeds imparting, to the cups, motions which enable the cartons to be picked up from a stationary magazine and deposited to continuously moving transport lugs for carton erection and transfer.

In such prior feeders, its objectives are attained by providing a rotating feeder having at least one planetary member rotatably mounted in the feeder. The planetary member carries at least one spindle carrying a suction cup for picking up a carton. The planetary member is rotated by a plurality of cam follower rollers operatively engaging a stationary, generally circular, sun ring mounted adjacent the carrier for engagement with the cam follower rollers. The cam includes a plurality of lobes of non-uniform pitch which cooperate with the rollers to cause the planetary members to rotate and thus the suction cups to engage the carton blanks with a conventional straight-in and straight out (perpendicular) component of motion at a carton magazine. Thereafter the suction cups are moved through an enclosed path toward a space between the advancing lugs of a carton blank transport conveyor, where the enclosed path has a horizontal component of motion. In one form, the path permits the deposit of the carton to occur over a period of about twice the length of time which would be permitted by conventional hypocycloidal motion of the spindle born suction cups. Thus, the apparatus permits an operation at substantially greater speeds than would be possible with a conventional hypocycloidal motion, while reliably partially opening cartons into a tubular shape as they are brought into engagement with blank transport lugs.

Thus, in the prior feeders, the suction cups at ends of their carrying spindles are driven in a curvilinear path having three cusps (depending on the respective ratios of the sun, planet and moon members).

Such a curvilinear path is redefined by the structure of Greenwell U.S. Pat. No. 4,518,301 where the cusps are redefined to compliment both carton blank picking from a magazine at a relative zero velocity and then placing the blanks between carton lugs on a conveyor at a velocity increment greater than zero for carton erection and transport.

These prior single sun ring or sun gear orbital feeders have proven useful but inherently present certain functional and feed thru limitations where it is desired to handle a variety of different size cartons, and at appropriate feed or through put rates.

As an example, given a fixed size or fixed diameter rotary feeder, such an apparatus may be designed to handle only one size carton. If the feeder is of sufficient diameter, it may be possible to provide one set of "planet" members and spindles (i.e., "moons") for one size carton and another set of planet members and spindles for a different size. So four spindles at 90° angular separation could be used for smaller carton blanks and only two spindles at 180° angular separation for larger blanks. This could be accomplished by eliminating or changing out two of the four spindles used for the smaller blanks. Should the operator desire to handle middle-size blanks however, the addition of further spindles into the system, at yet different angular orientation on the feeder, could clash or engage other spindles or cartons or interfere with the other components, not to mention the more significant issue of the rotational phases required for the different angular phase of the "planets" and "moons" in a three-count orientation as compared to a two-count or four-count construction.

Accordingly, the potential variation of the carton blank size is extremely limited by the size and structure of the feeder components and operation. While the rotational phases of the planets and spindles may be in sync for multiples such as two or four spindle locations, the need to provide feeding for in-between midsize carton blanks, such as three spindle orientation in a feeder of the same size is wanting of a solution.

So, the rotational phases of spindles for a three-spindle set at 120° angular spacing is out of sync with a two or four spindle set at 180° or 90° spacing and the ability to handle a wide variety of carton blank sizes at desired through put rates is limited. Spindles or blanks for one carton size interfere with other spindles for blanks of different size during operations.

Adaptation or change over for a variety of carton blank sizes is extremely limited in the prior feeders as is the ability to provide enhanced blank hand-off at place stations while retaining a zero velocity cusp at the blank pick station from the carton magazine.

Those of ordinary skill in rotary blank feeding will readily appreciate these noted difficulties and concerns, as well as others.

Cartoning users are thus left with undesirable options such as overbuilding rotary feeders to disproportionate diameters to somehow accommodate more spindles at different angular spacing, even if the operational pick and place functions could be attained. Purchase and operation of multiple production lines due to the need to handle multiple carton size at desired rates is undesirable duplication and expense.

Accordingly, it has been an objective of this invention to provide a single rotary blank feeder capable of handling one, two, three or four blanks per feeder revolution or cycle for respective large carton blanks, medium carton blanks and small carton blanks, alternatively, with larger cartons at slower speeds and medium and smaller carton blanks at progressively higher speeds, on the same apparatus or cartoning line.

It has been a further objective of the invention to provide a rotary or orbital blank feeder, as above for a variety of blank sizes, while also preserving a zero velocity cusp at a blank pick station and improved blank hand-off control at a blank place station.

A further objective of the invention has been to provide apparatus and methods to increase size range of work pieces or carton blanks at appropriate through put rates on the same rotary feeder.

SUMMARY OF THE INVENTION

To these ends, a rotary feeder is provided with plural cams, preferably but not necessarily identical, and two in number, referred to as sun rings, on a common axis and in angular phase with respect to each other. Each preferably identical cam includes a plurality of complimentary cam surfaces, and the cams are spaced axially, preferably adjacent, along the common axis.

A plurality of rotary planetary members, preferably but not necessarily three in number, are operatively engaged with a first of the cams, such as for middle-sized cartons, while a second plurality of other rotary planetary members, preferably but not necessarily three in number, are operatively engaged with a second of the cams, and cooperate with at least one of the three planetary members driven by the first cam, to selectively provide for small or large carton blank transfers.

Spindles are selectively and removably mounted on respective rotary planetary members for rotation therewith. For example, one or more spindles are selectively mounted on selected ones of the planetary members driven by the first cam. Alternately, one or more other spindles are selectively mounted on the planetary members operatively associated with the second cam along with one of the three spindles driven by the first cam.

When large blanks are to be handled, two spindles are selected, for example, one on a planet member rotated by the second cam and one on a planet member associated with the first cam respectively. Alternately, only one spindle is mounted on a planetary member rotated by only one cam for handling large blanks.

When small cartons are to be handled, four spindles are selected, for example, three carried by planet members associated with the second cam, and one by the planet member associated with the first cam.

When middle-size cartons are selected, three spindles are selected, for example, on planet members in operative engagement with the first cam, while spindles on the planet members are selectively removed from the planet members associated with the second cam.

Unused or non-selected spindles are preferably removed from planetary members of the feeder so no spindle or blank interference occurs during planetary rotation in the circular path about the common axis. Vacuum is fed through each planetary member to each operative spindle and suction cup thereon, but is blocked from the other spindle positions respectively associated with the non-selected removed spindles.

The cam surfaces of the respective cams, together with the operatively associated planetary members, are selected to provide a four-cusp enclosed path for suction cup ends of any mounted spindle such that a zero velocity cusp of the path is provided at a pick station proximate a discharge end of a blank magazine and an elongated cusp of the path is provided at a place station proximate a carton conveyor to enhance blank placement.

Preferably but not necessarily, the number of planet/spindle assemblies are six in total number, with a first plurality of three driven planet members rotated by engagement with the first cam and a second plurality of three driven planet members rotated by engagement with the second cam. When the first plurality is selected (for middle size carton blanks), they are oriented angularly at 120° about the common cam axis and they are all operatively rotated by engagement with the first cam as the planet members move in circular path about the common cam axis. When planetary members of the second plurality are selected, as when smaller carton blanks are to be handled, they are rotated by engagement with the second cam and preferably combined in operation with one of the first plurality of planet members rotated by the first cam. All are angularly separated at 90° about the common axis.

Alternately, when two planet/spindle assemblies are selected for larger cartons, one of the first plurality and one of the second plurality are selected, each driven or rotated by a separate one of the in phase cams, and the planet/spindle assemblies are at 180° angular spacing about the common axis. Also, only one planet/spindle can be selected for yet larger blanks.

It will be appreciated that each of the cams have plural cam surfaces, each cam operable to cause rotation of respective planet members associated therewith to produce a preferred enclosed path, traced by ends of the respective spindle members or suction cups, with four apexes or cusps of directional path change. One of the cusps represents zero velocity of the path and one cusp has an elongated portion representing a velocity greater than zero for blank placing on a carton conveyor.

Preferably, but not necessarily, the cams have their cam surfaces directed inwardly toward the common axis. Also, it will be appreciated that while the cams are preferably identical, they may be varied in inconsequential manner of construction without deviating from the scope of the invention.

It will be appreciated further that while the invention includes a plurality of cams, as described, planetary members and spindles driven by one cam may cooperate with planetary members and associated spindles driven by another cam, or may be used alone in a variety of combinations as desired for a variety of desired blank feeding operations.

Thus one embodiment of the invention preferably accommodates three alternative sets of selectable planet/spindle assemblies, 1, 2, 3 or 4 in number, selectable to accommodate small, large and mid-size carton blanks while retaining and improving the carton blank path at pick and place stations. Change out for carton blank size is expedited by simply removing or mounting spindle assemblies on selected planetary members.

Thus in another embodiment, the invention preferably comprises a rotary carton feeder for feeding carton blanks from a carton magazine to a carton conveyor, said feeder comprising: a plurality of cams, each cam having cam surfaces in angular phase with those cam surfaces of another cam; a plurality of rotatable planetary members; one set of said members of said plurality respectively mounted in operative engagement with one of said cams and another set of said planetary members in operative engagement with another one of said cams; respective carton holding spindle members selectively mountable on and removeable from respective ones of said rotatable planetary members; said plurality of said cams coaxially mounted about a common axis with said cam surfaces of one cam in the same angular phase with respect to the cam surfaces of another cam about said common axis, said cams spaced axially along said axis one from the other, and said rotatable planetary members respectively moveable in a circular path about said common axis while in respective operative engagement with one of said cams for rotation about a respective planetary member axis. Preferably, but not necessarily, the cams are identical.

Another embodiment of the invention preferably comprises: A rotary feeder of the type having a first sun ring, cam surfaces on said sun ring, a first plurality of rotatable planetary members in operative engagement with said sun ring and item holding spindles selectively mountable on and removeable from selected ones of said planetary members, further comprising: a second sun ring having cam surfaces thereon, said cam surfaces of said two sun rings being in the same angular phase with respect to each other about a common axis, a second plurality of rotatable planetary members in operative engagement with said second sun ring; and respective spindles mountable on and removeable from selected ones of said second plurality of rotatable planetary members. Preferably, but not necessarily, the sun ring and cam surfaces thereon are identical.

A yet further embodiment of the invention comprises a rotary feeder as described herein where only one planetary member and associated spindle is selected for handling a single one blank for each feeder revolution.

Further, it will be appreciated that the invention even more broadly stated and in one embodiment comprises a rotary feeder having a plurality of guides, each with a set of guide surfaces, a first set of planetary members operatively engaging a set of guide surfaces on one of the guides and a second set of planetary members in operative engagement with a set of guide surfaces on another of the guides, where the guides are oriented in respective planes developed about a common axis and axially spaced along the common axis and including respective spindles removably mountable on respective planetary members.

In yet another embodiment, the invention comprises a rotary blank feeder having rotatable members mounted for respective rotation about a common axis in a circular path and a plurality of blank holding spindles, selected ones of which are individually mountable on and removeable from selected ones of the rotatable members, wherein the rotatable members with spindles thereon are alternatively selectable for feeding, in the alternative, one, two, three or four blanks for each revolution of the rotatable members about the common axis and wherein spindles are removed from non-selected rotatable members.

Another embodiment of the invention preferably comprises: A method for picking carton blanks from a pick station proximate a carton magazine and placing picked blanks in a place station, the method accommodating a variety of blank sizes and including the steps of: picking and placing carton blanks with a rotary feeder having a plurality of carton holding spindles mounted respectively on rotatable planet members, in turn mounted for respective motion in a circular path about a common axis and in operative engagement respectively with one of two respective circular cam rings; selecting the total number of spindles from one of one, two or four spindles; and alternatively selecting the total number of three spindles on rotatable planet members in operative engagement with only one of said circular cam rings.

The method may also include rotating respected planetary members through operative engagement with a plurality of identical cams.

The method may also include moving the carton blanks through a portion of an enclosed path defining four cusps of said portion extending from a cusp having a relative zero velocity though an elongated cusp.

Methods attendant these objectives and advantages are provided as will be appreciated.

Various components and features of these embodiments can be combined with other components or embodiments of the invention.

Advantages provided by the invention in general and by the various embodiments described herein include apparatuses and methods wherein one blank or item feeder is capable of providing handling of blanks or items of a wide variety of sizes on the same apparatus without interference from apparatus components, blanks or items when changing from one size to another. Extra costs of multiple feeders otherwise needed handling various blank or item feeding are eliminated since all are handled on a single feeder, and all with provision of desired handling rates and throughput.

BRIEF DESCRIPTION OF THE DRAWINGS

These and other objectives and advantages will be readily appreciated and understood from the following detailed description and the drawings in which:

In FIG. 5B, note cam 30 is not in operative engagement with planetary member 1.

DETAILED DESCRIPTION OF PREFERRED EMBODIMENTS OF THE INVENTION

Figure 1:
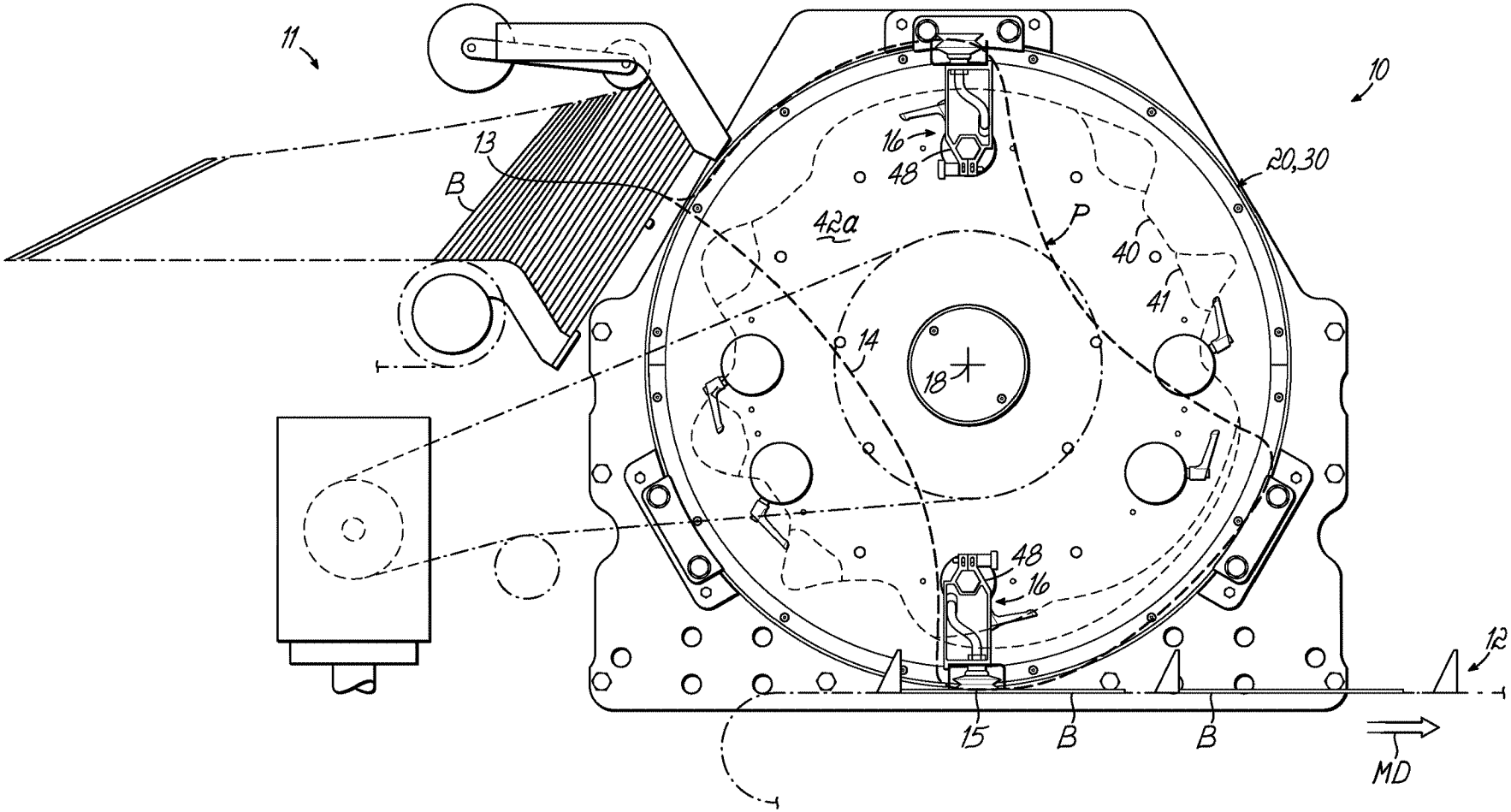
FIG. 1 is a diagrammatic elevational view of a rotary feeder in accordance with the principles of this invention in use with a carton blank magazine and a carton conveyor, showing one embodiment of the feeder with two operational spindles selected, and showing the enclosed path traversed by the spindle carton blank suction cups.

Turning now to the drawings there is illustrated in FIG. 1 a rotary carton feeder 10. While the invention is useful in feeding folded, flattened carton blanks B from blank magazine 11 to a carton blank conveyor 12, the invention is easily adaptable for use in other applications for transferring items from one position to another. For purposes of this application, the invention will be described in a preferred embodiment for use as noted in a rotary, or orbital carton blank feeder 10.

In execution of the invention then, a blank B is engaged at a pick point from magazine 11 and transported to a place station on conveyor 12. The blank is transported through a portion 14 of an enclosed, four cusp path P, from the pick point at cusp 13 of path P to a place station at elongated cusp portion 15 of path P at conveyer 12 for downstream transport in a machine transport in a machine direction MD. In this embodiment, folded B blank is then conveyed downstream where it is subjected to any suitable blank erection process (not shown) which is not a part of this invention. Such erection can include blowing air or by blank manipulation by erecting suction cups, conveyor lugs or the like. If desired, blank motion under the influence of the feeder 10 would also be used in the blank erection process.

Figure 1A:
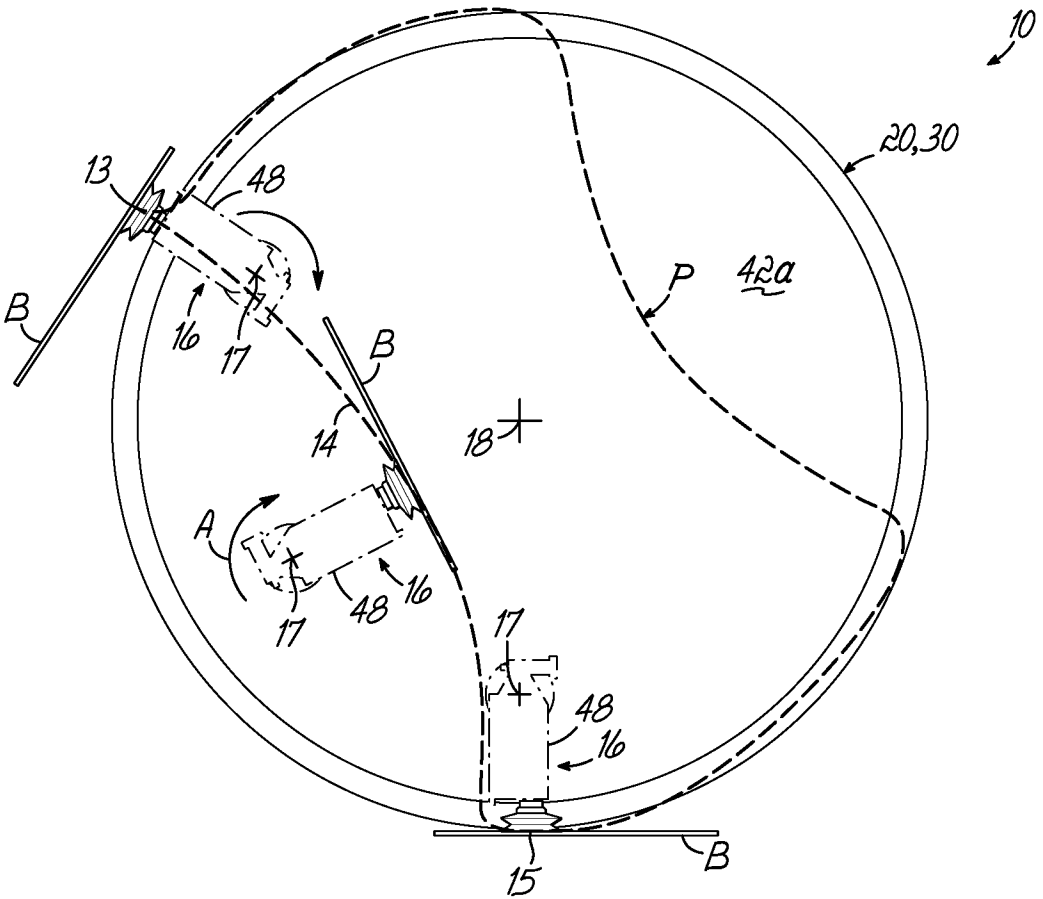
FIG. 1A is a diagrammatic view of a portion of FIG. 1 illustrating the enclosed four cusp path traversed by a representative spindle mounted suction cup and a carton blank motion through a part of the path.
Figure 2:
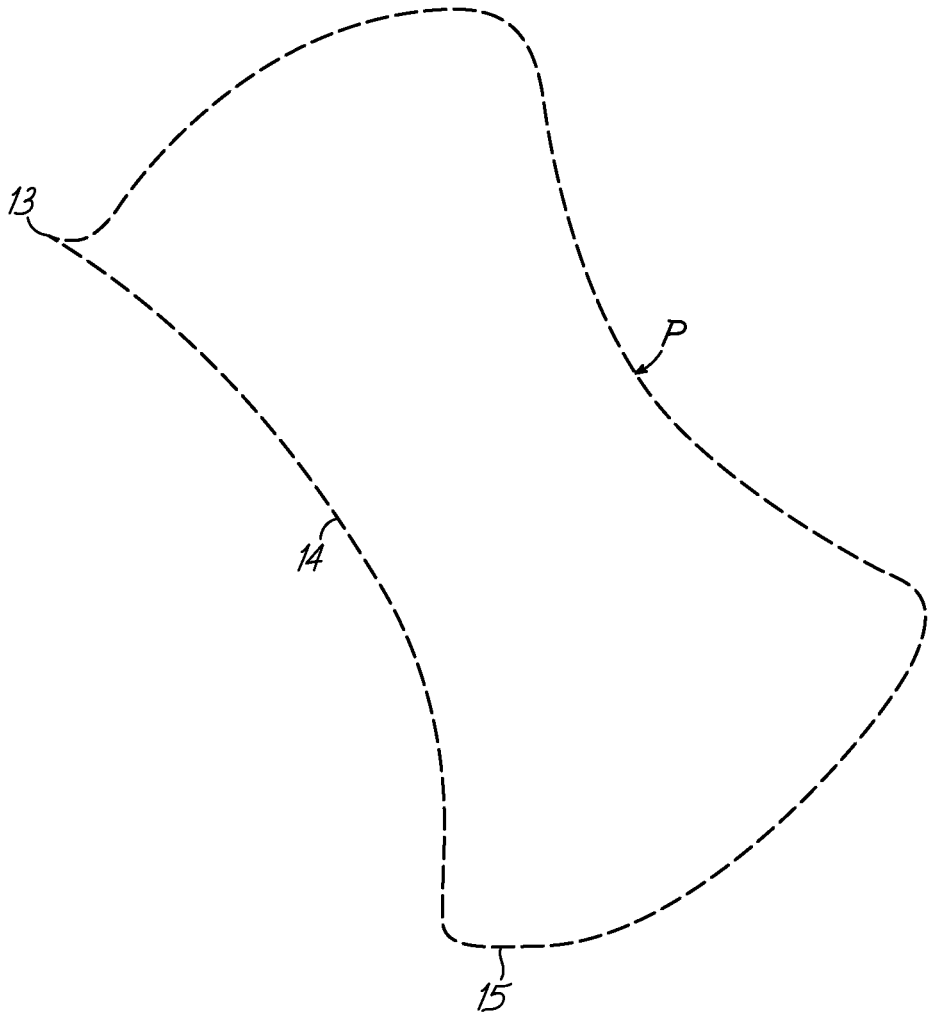
FIG. 2 is a diagrammatic view of the enclosed four cusp path of FIGS. 1 and 1A.

As shown in FIG. 1A, a representative spindle assembly 16 (in dashed lines) rotates about pivot 17 of a representative planetary member in the direction of arrow A.

It will be appreciated that suction cups carried by the respective spindle assemblies described herein move through the path P as the planetary members on which they are mounted rotate on their axes and revolve around a common axis 18 as will be described.

Representative spindle assembly 16 is similar to other spindle assemblies described further herein, the spindles being selectively applied as further discussed. By way of example only, 2 spindle assemblies 16 are selected and shown in FIG. 1 for illustration.

According to a preferred embodiment of the invention, feeder 10 includes a plurality guides in the form of circular cams, here shown as two cams 20, 30, sometimes also referred to herein as cam rings or sun gear rings. First and second cams 20, 30 each also form individual "sun" rings of a sun, planetary members and moon members of a motion system commonly referred to by that name. However, in this invention there are a plurality of separate cams, preferably but not necessarily, two of them, 20, 30.

Figure 3:
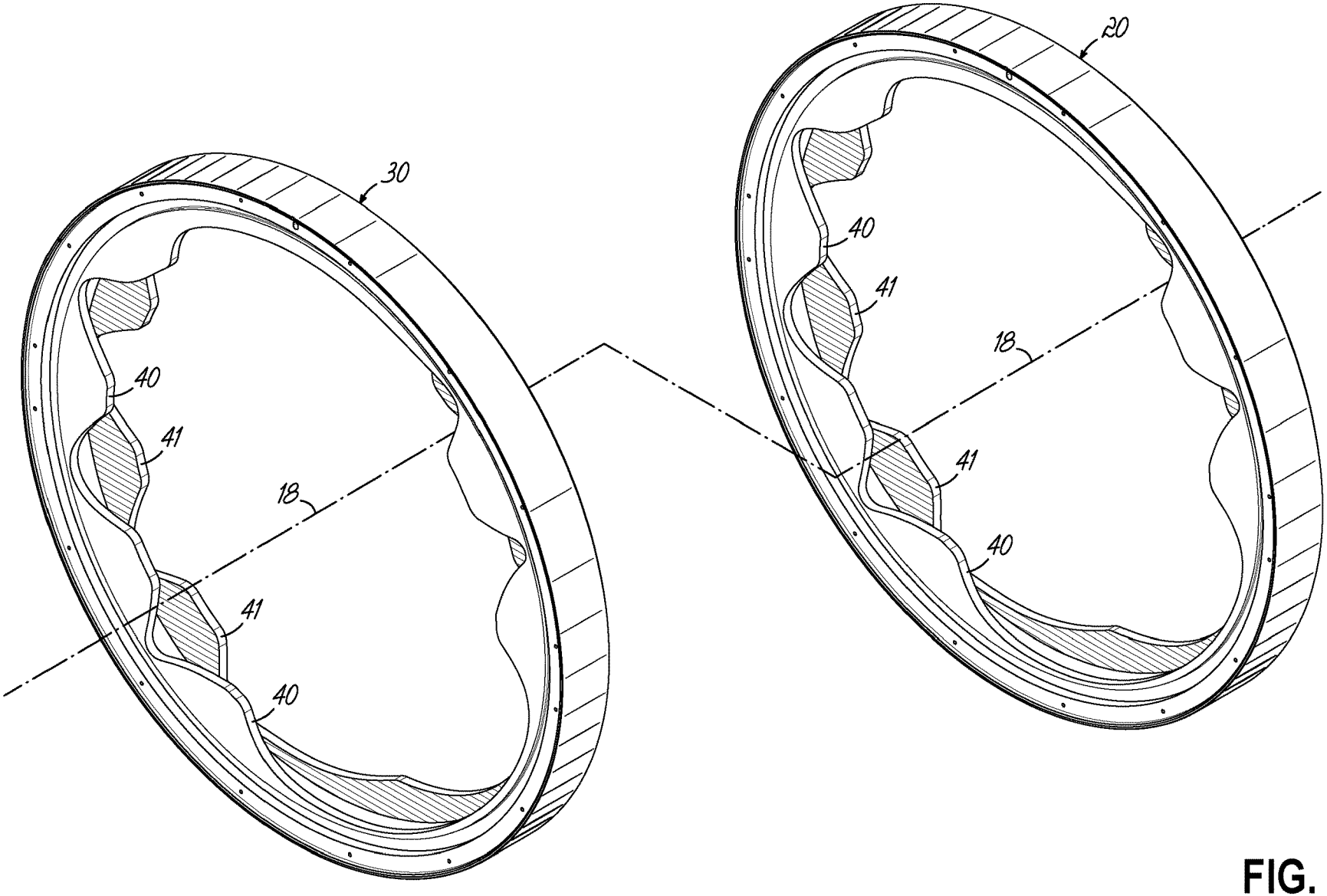
FIG. 3 is an exploded isometric and diagrammatic view illustrating first and second cams of the feeder of the invention, each cam having respective cam surfaces thereon and each cam developed about a common axis and spaced axially with respect to each other.

As shown in FIG. 3, cams 20, 30 are developed about a single common axis 18 and are axially spaced there along, one from the other, preferable adjacent. Cams 20, 30 are preferably fixed or non-rotationally mounted about axis 18 and are thus preferably angularly and non-rotationally stationary.

Preferably cams 20, 30, are identical to each other and can be referred to as "twin" cams. It is to be understood that the structure of cams 20, 30 can be varied in certain non-identical features which do not adversely affect their function in operative engagement with respective rotatable planetary members described herein.

Figure 4:
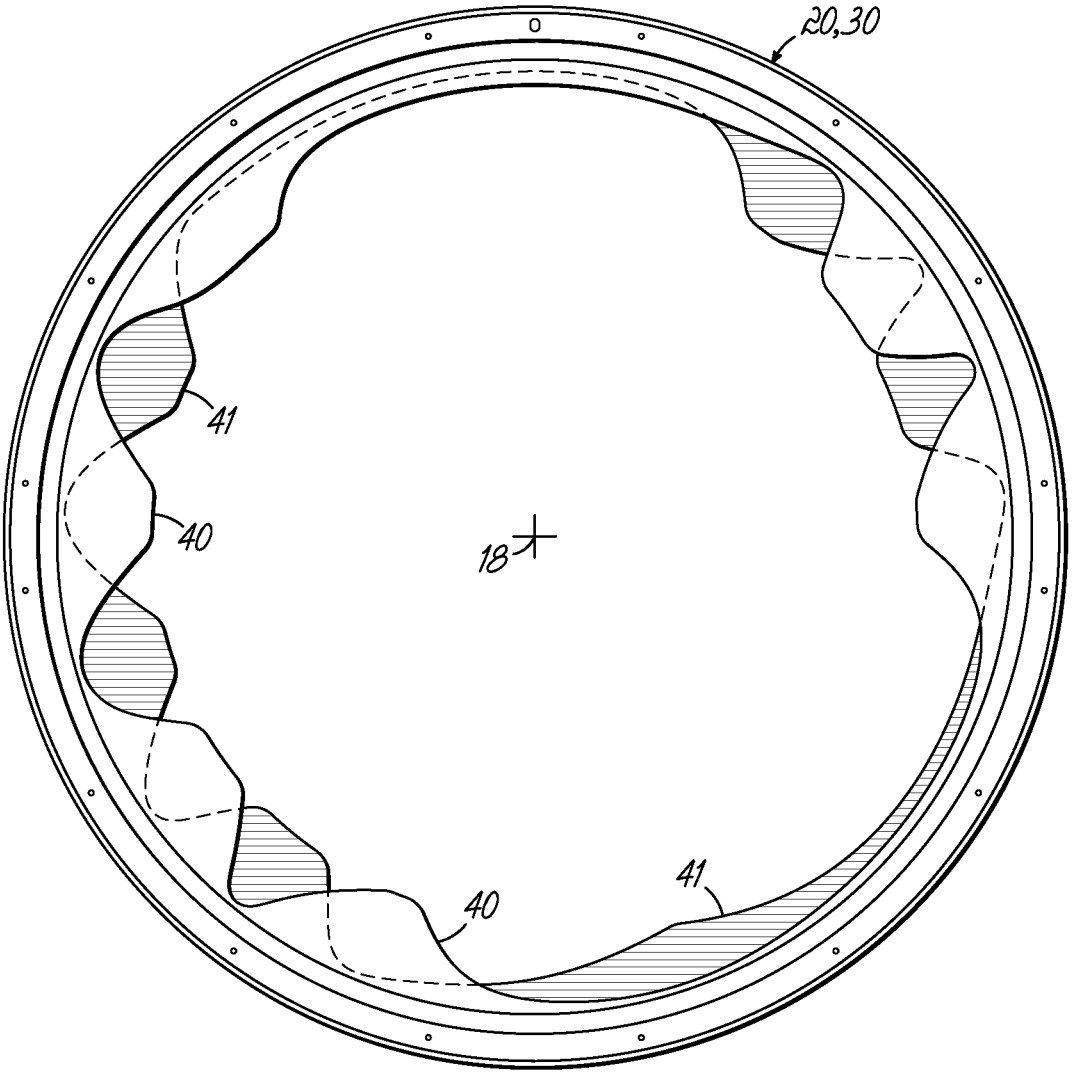
FIG. 4 is an elevational diagrammatic end view of either of the cams of FIG. 3; illustrating the plural cam surfaces there in partial cross-section.

Each cam 20, 30 preferably includes two undulating cam surfaces 40, 41 (FIG. 3) portions of surface 41, referred to as "lobes" shown in dashed lines (FIG. 4).

Feeder 10 also includes a first plurality of planet or planetary members respectfully numbered as 1, 2 and 3. Note that planetary members 1, 2 & 3 are operatively engaged with surface 40, 41 of first cam ring 20, while three further planetary members 4, 5 and 6 are operatively engaged with surfaces 40, 41 of the second cam ring 30.

The planetary members 1-6 are preferably sandwiched between preferable circular cover support or end plates, such as rotatable planet carriers 42*a*, 42*b* and are rotatably mounted thereon for rotation with respect thereto. The support or carrier plates 42*a* and 42*b* are mounted in feeder 10 for driven rotation therein, about axis 18 and with respect to cams 20, 30. Support places 42*a* and 42*b* are driven by any suitable mechanism such as that described in U.S. Pat. No. 4,518,201 to Greenwell, and carry the planetary members 1-6 about the common axis 18 in a circular path.

Accordingly, as will be appreciated, planetary members 1-6 are each rotatable about their individual and respective axes on the rotatable carriers 42*a*, 42*b*. As well, the planet members move in circular path about the common axis 18 when the carriers 42*a* and 42*b* are driven or revolve about that axis 18. Movement of the planetary members 1-6 in that circular path about axis 18 causes then each to rotate about their own axes under the influence of, and in respective engagement with the stationary cams 20 or 30 in operative engagement therewith.

Figure 5:
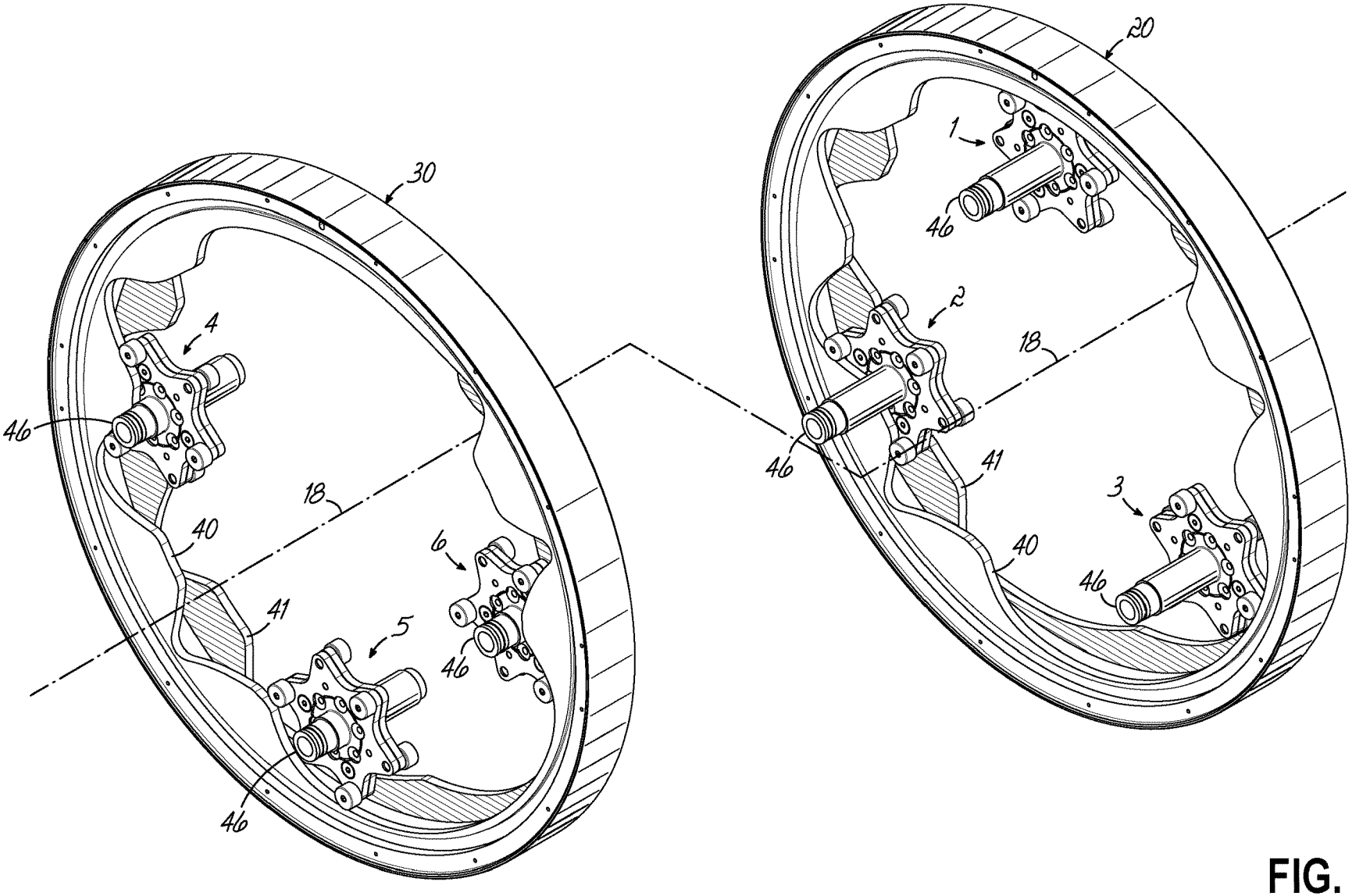
FIG. 5 is an exploded isometric and diagrammatic view similar to FIG. 3 and further illustrating the cams and with three respective planetary members in operative engagement with each one of the respective cams and the respective cam surfaces of each.
Figure 5B:
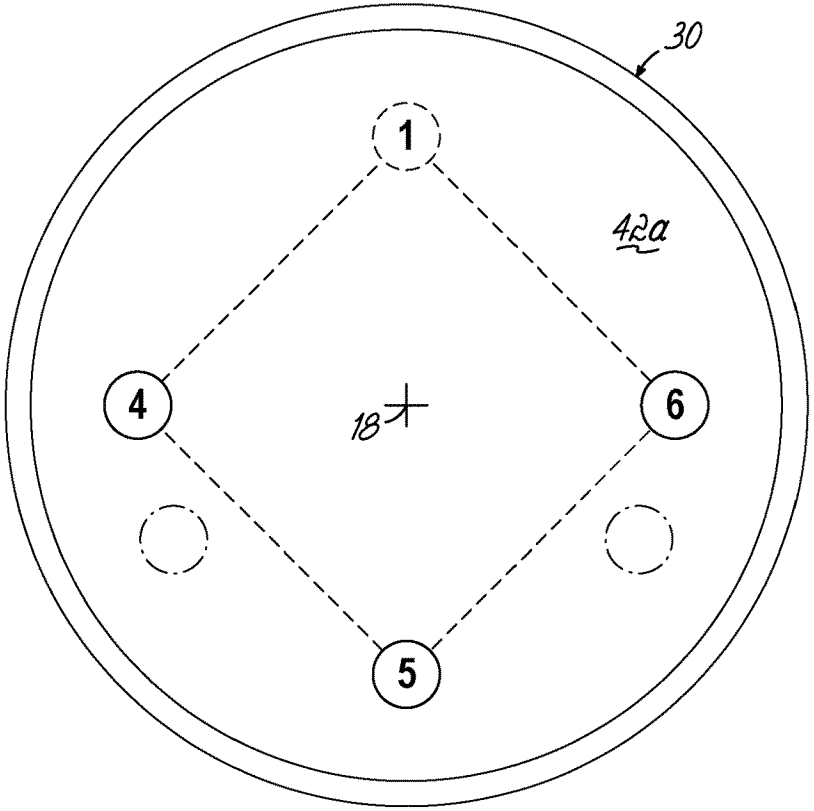
FIG. 5B is a diagrammatic, elevational and explanatory view illustrating three other planetary members operational engaged by the second of the cams in FIGS. 3 and 5.
Figure 5A:
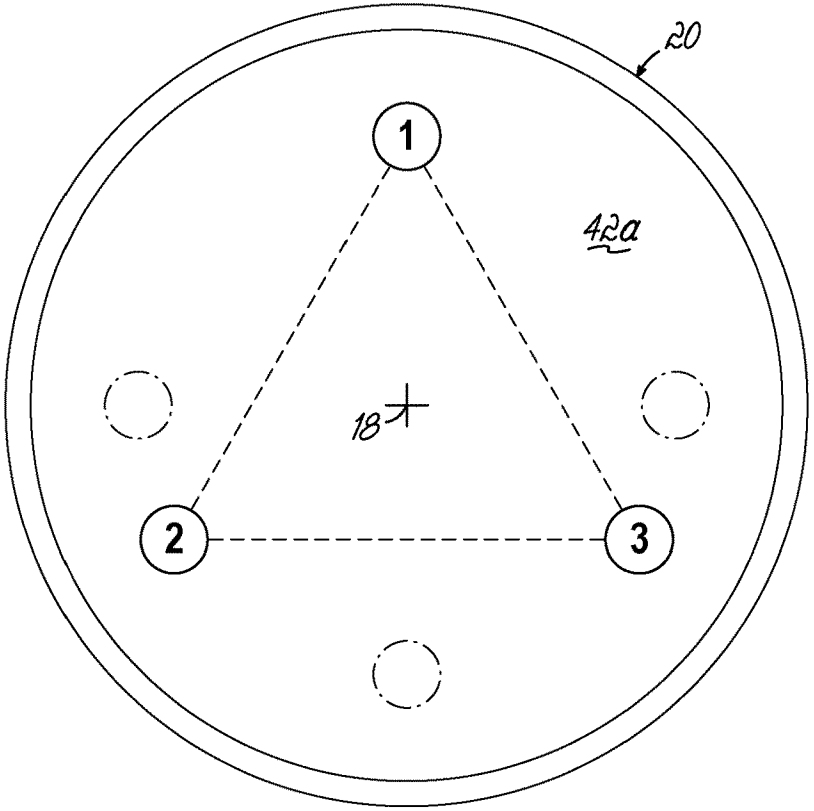
FIG. 5A is a diagrammatic and explanatory elevational view illustrating three planetary members operatively engaged by the first of the cams in FIGS. 3 and 5.

FIGS. 5A and 5B diagrammatically illustrate the operative engagement of cam 20 only with planetary members 1, 2 and 3, and the operative engagement of cam 30 only with planetary members 4, 5 and 6.

FIGS. 5A and 5B illustrate the relative angular spacing of the planetary members 1-6. Members 1, 2 and 3 are at 120° angular spacing about axis 18. Members 4, 5 and 6 are at 90°, 180° and 270° about axis 18. Member 1, not operationally connected to cam 30, is in the Figs. shown at 0° for illustration. This spatial relationship remains even while the members 1-6 revolve in a cycle about axis 18 through 360° of revolution.

Figure 19A:
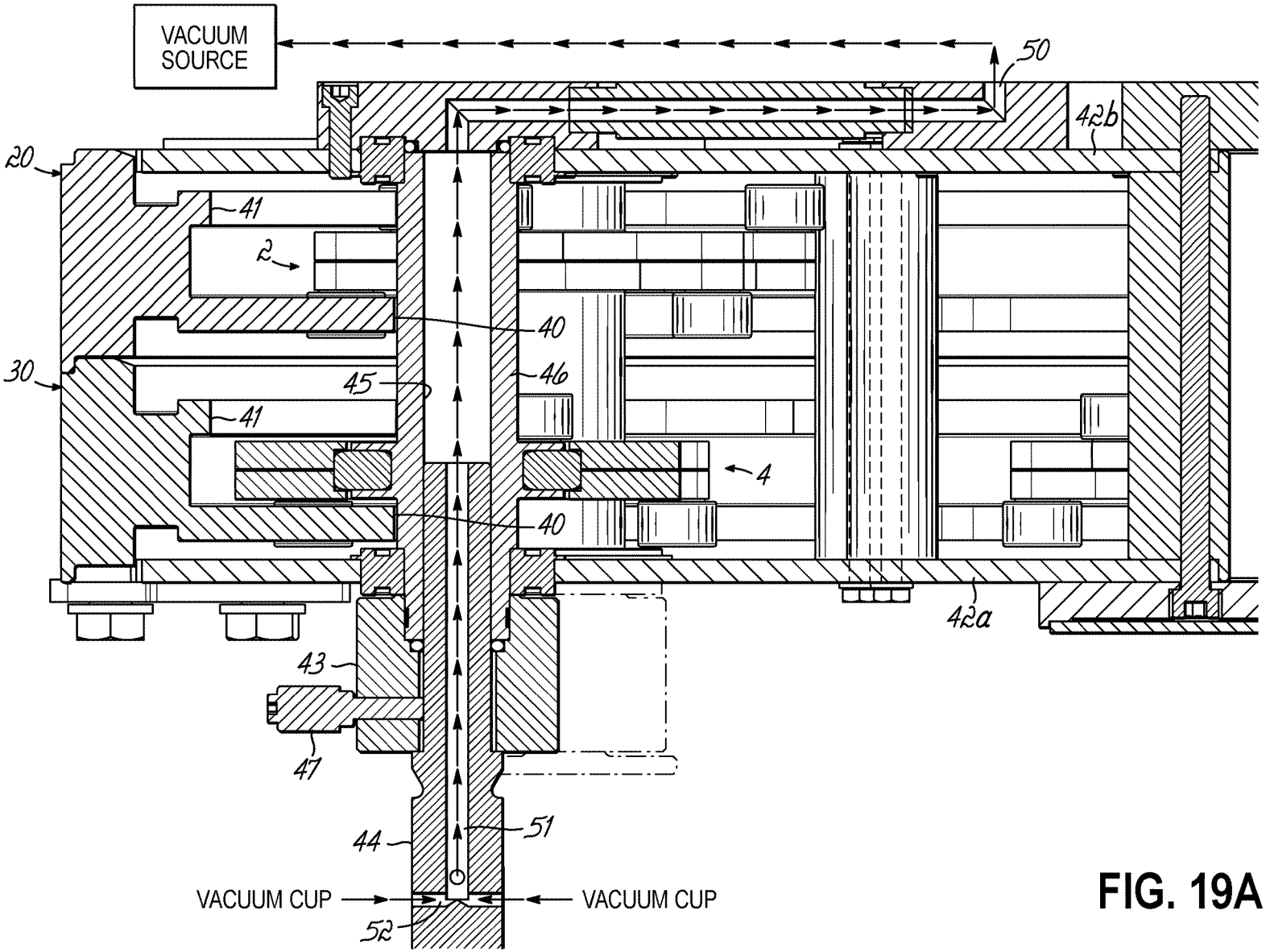
FIG. 19A is a cross-sectional view taken along lines 19A-19A of FIG. 8 illustrating further details of a representative planetary member of the invention, and illustrating a selected spindle shaft mounted thereon with vacuum illustrated passing through the spindle shaft to spindle arms and section cups thereon, not shown for clarity.
Figure 19B:
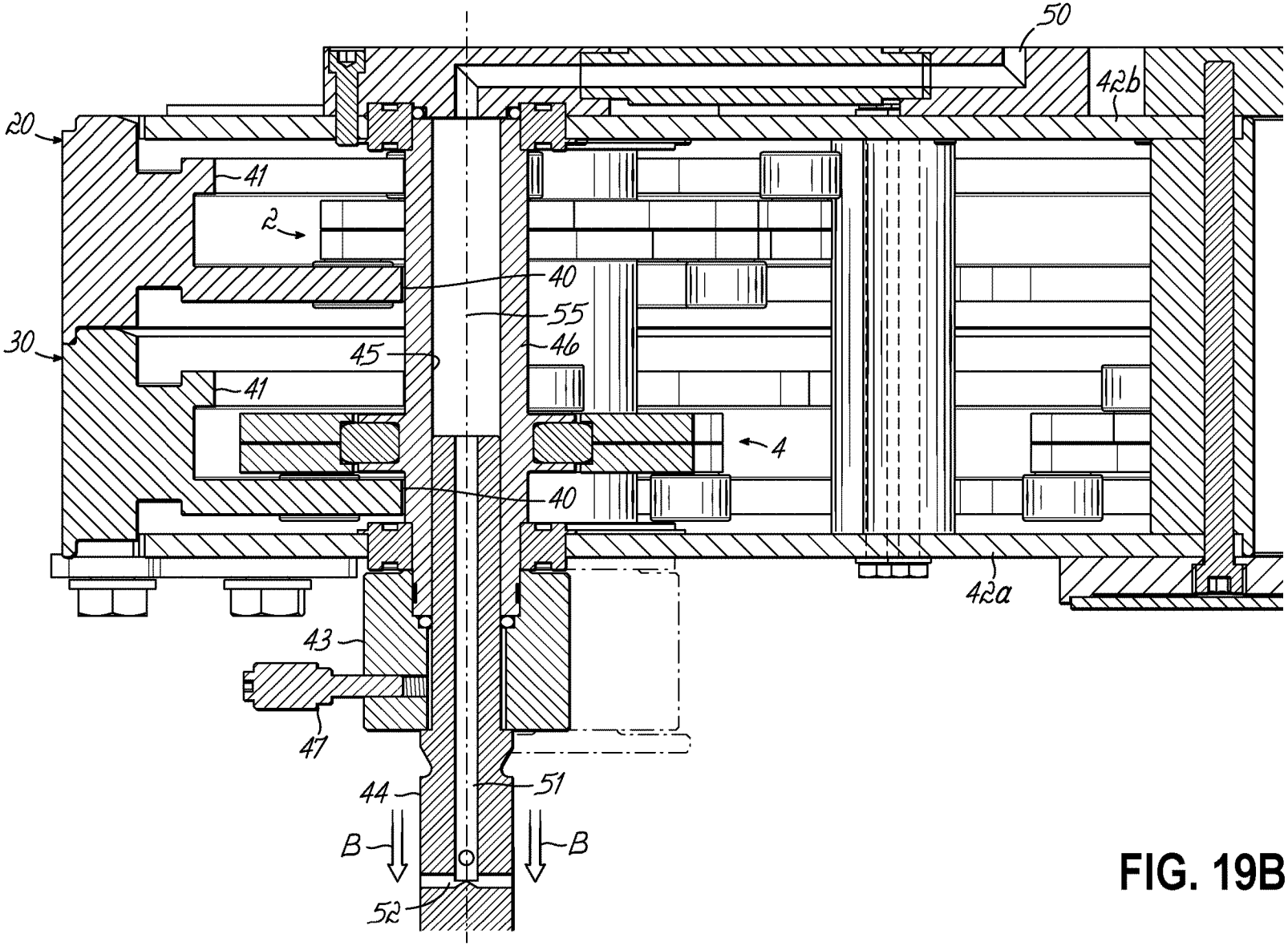
FIG. 19B is a cross-sectional view similar to FIG. 19A but illustrating selective removal of a spindle shaft and assembly from the planetary member.

Turning momentarily to FIGS. 19A, 19B at 19C, as well as briefly to FIGS. 1 and 16-18, reference is made to planetary members 1-6 and to the cross-section of those members in 19A-19C.

It will be appreciated that each planetary member 1-6 is preferably but not necessarily identical to the others. Also, selectively and removably mountable on each planetary member 1-6 is a removeable spindle assembly 16, via a spindle shaft 44.

Each spindle assembly 16 includes spindle shaft 44 telescoped into a bore 45 of sleeve 46 of a planetary member (1-6). Spindle shafts 44 extend co-axially from respective planetary members 1-6 about their respective axes of rotation and parallel to common axis 18. Shaft 44 is removably secured in a sleeve 46 of a planetary member, 1-6, via a set screw 47, through collar 43. Sleeves 46 are of appropriate length to extend outwardly of carrier plate 42*a*. Collars 43 are visible on the front of carrier plate 42*a* and there represent the planetary member positions thereon as noted in the Figs. by the respective number of those members. Collars 43 extend outwardly from circular carrier plate 42*a*.

Shaft 44 of each spindle carries one or more spindle arms 48 of the spindle assembly 16 (FIGS. 1, 5 at 16A, 16B, 17A, 17B, 18A and 18B). For rotation with shaft 44 as shown in the Figs. A vacuum suction cup 49 of spindle assembly 16, is operably disposed on the end of each spindle arm 48.

It is the suction cup 49 on the end of each spindle arm 48 which respectfully holds and transports a carton blank B from cusp 13 to cusp 15 of path P when the spindle assembly 16 is selectively attached to a respective planetary member 1-6. Each suction cup 49, in use, traverses path P, including portion 14 thereof.

It will be appreciated that spindle assemblies 16, together with their components, shafts 44, arms 48, and suction cups 49 are preferably, but not necessarily, identical, that the shafts 44 and suction cups 49 may be varied in number, and that the length of shafts 44 may be varied as desired.

Figure 8:
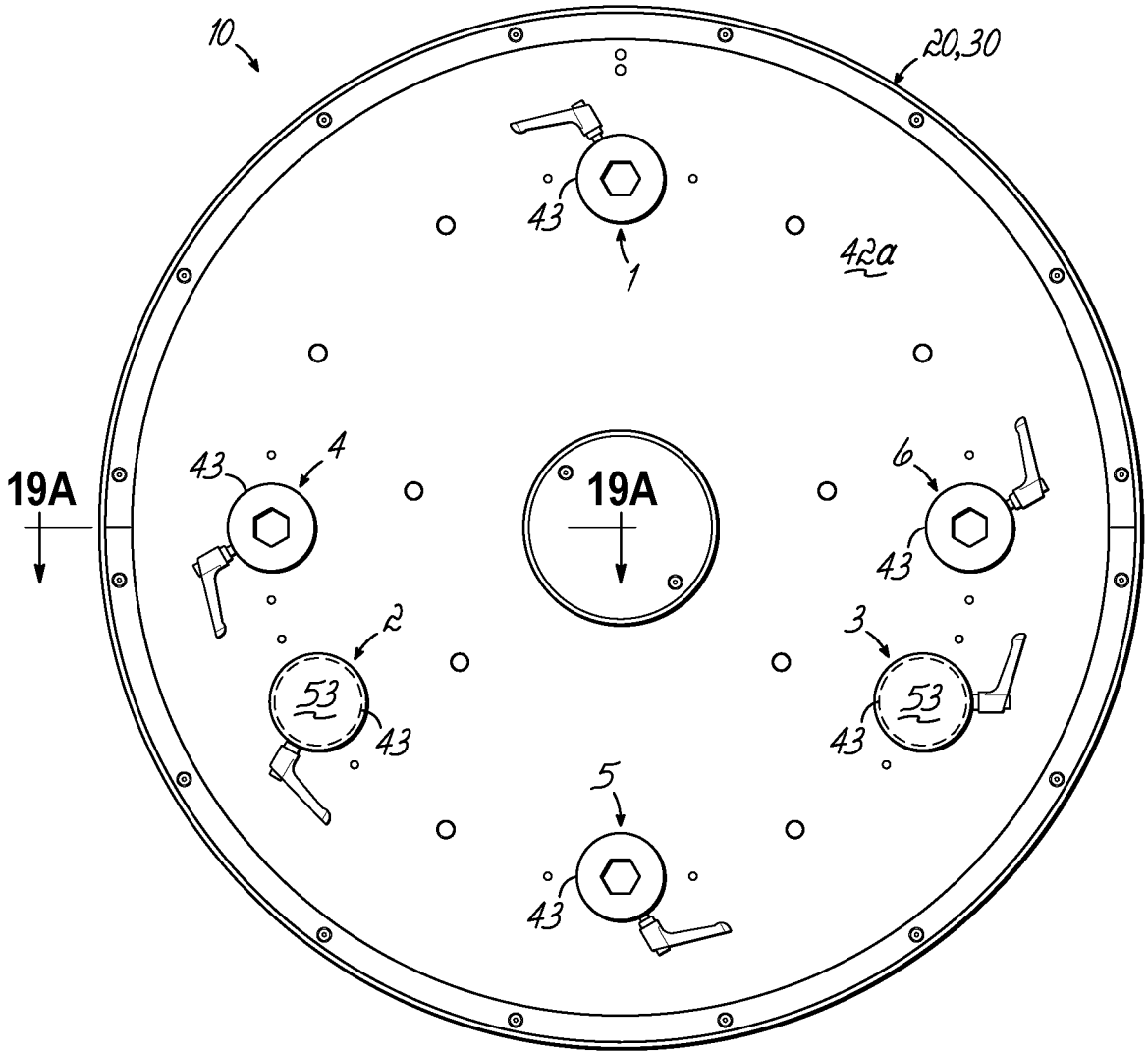
FIG. 8 is a diagrammatic elevational view as in to FIG. 6 but showing 4 selected operative planetary members angularly spaced at 90 degrees apart for receiving respective spindle assemblies (not shown), and 2 inoperative, capped planet members at 120° angular spacing.
Figure 19C:
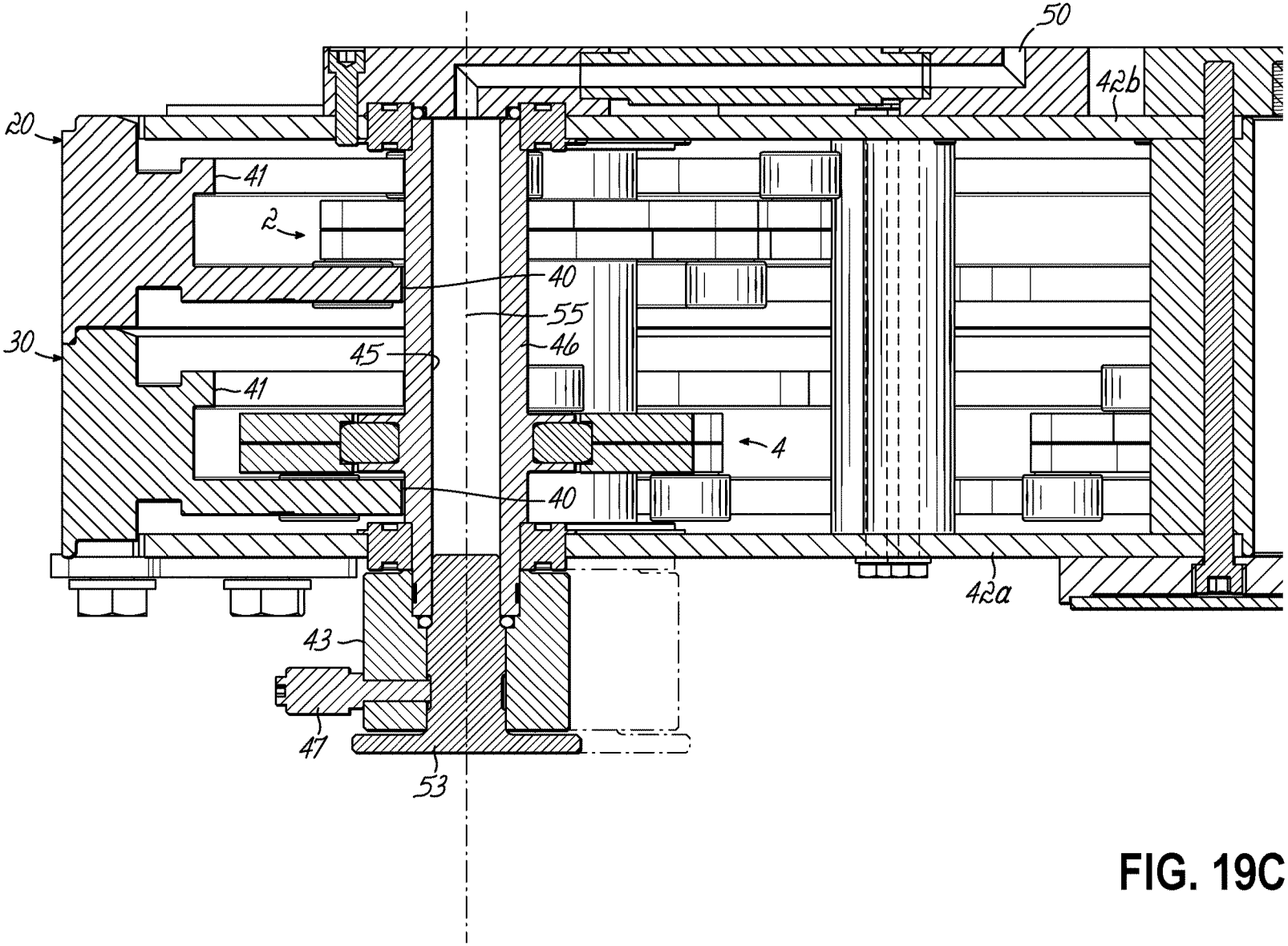
FIG. 19C is a cross-sectional view taken along lines 19C-19C of FIG. 9 illustrating a representative planetary member of the invention where suction to the spindle assembly has been capped when no spindle assembly is mounted thereto.

With attention to FIGS. 19A, 19B, and 19C, note that FIG. 19A is a cross-section of a portion of the feeder 10 in FIG. 8 where a representative planetary member 4 is angularly located about axis 18 at 270° thereabout when in the illustrated revolutionary position shown in the Figs. Accordingly, the planetary member 4 is operatively engaged with surfaces 40, 41 of cam 30. No other planetary member 1, 2, 3, 5 or 6 is in operative engagement with surfaces 40, 41 of cam 20 at this particular angular position.

Vacuum is introduced to shaft 44 of a representative spindle assembly 16 as illustrated by the succession of arrows in passages 50, sleeve 46, bore 45, and passages 51 and 52.

Figure 9:
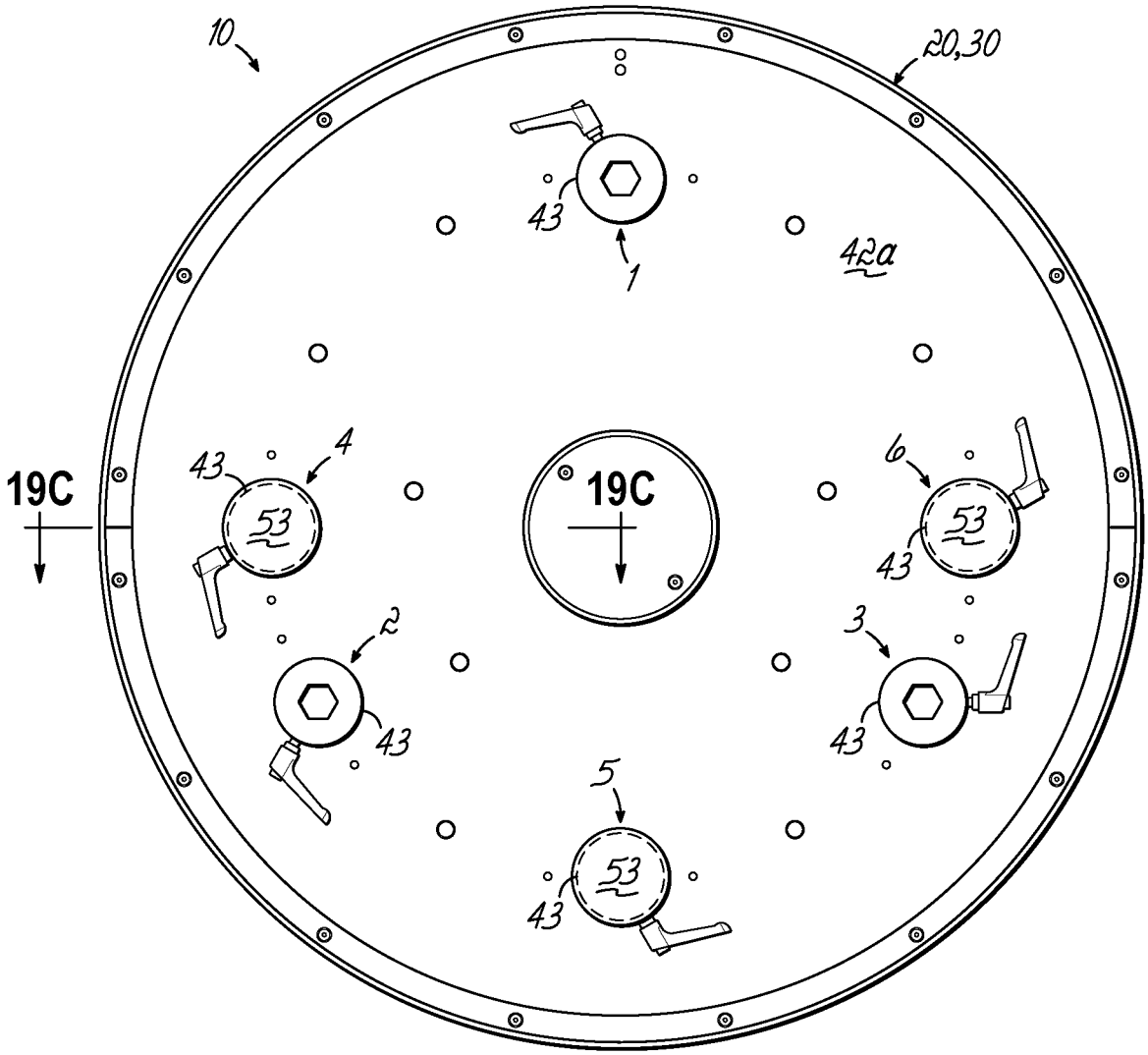
FIG. 9 is a diagrammatic elevational view as in FIG. 6 but illustrating 3 selected operative planetary members, angularly spaced 120 degrees apart, for receiving three respective spindle assemblies (not shown), and 3 inoperative and capped planetary member positions.

And in FIG. 19C, which is taken from FIG. 9, note the representative planetary member 4 at the 270° rotary position of feeder 10, cooperating with cam 30, is now blocked off from vacuum by means of any suitable cap 53.

Thus the planetary member 4, when carrying a spindle assembly 16 is as shown in cross-section in FIG. 19A. The same planetary member 4, when selectively not carrying a removeable spindle assembly 16, is illustrated in FIG. 19C, and FIG. 9.

FIG. 19B is illustrative of the removal (Arrows B) of spindle assembly 16 (shaft 44) when no spindle assembly in selected for mounting on a planetary member such as planetary member 4.

Also, note that spindle assemblies 16, when selectively mounted to a planetary member, extend co-axially from a respective planetary member at an axis of rotation 55 thereof (See FIGS. 19B, 19C).

It will be appreciated the cross-sections in FIGS. 19A, 19B, 19C are representative of all planetary members as they revolve through the angular position of 270°. These cross-sections change as the planetary members revolve about axis 18.

Figure 10:
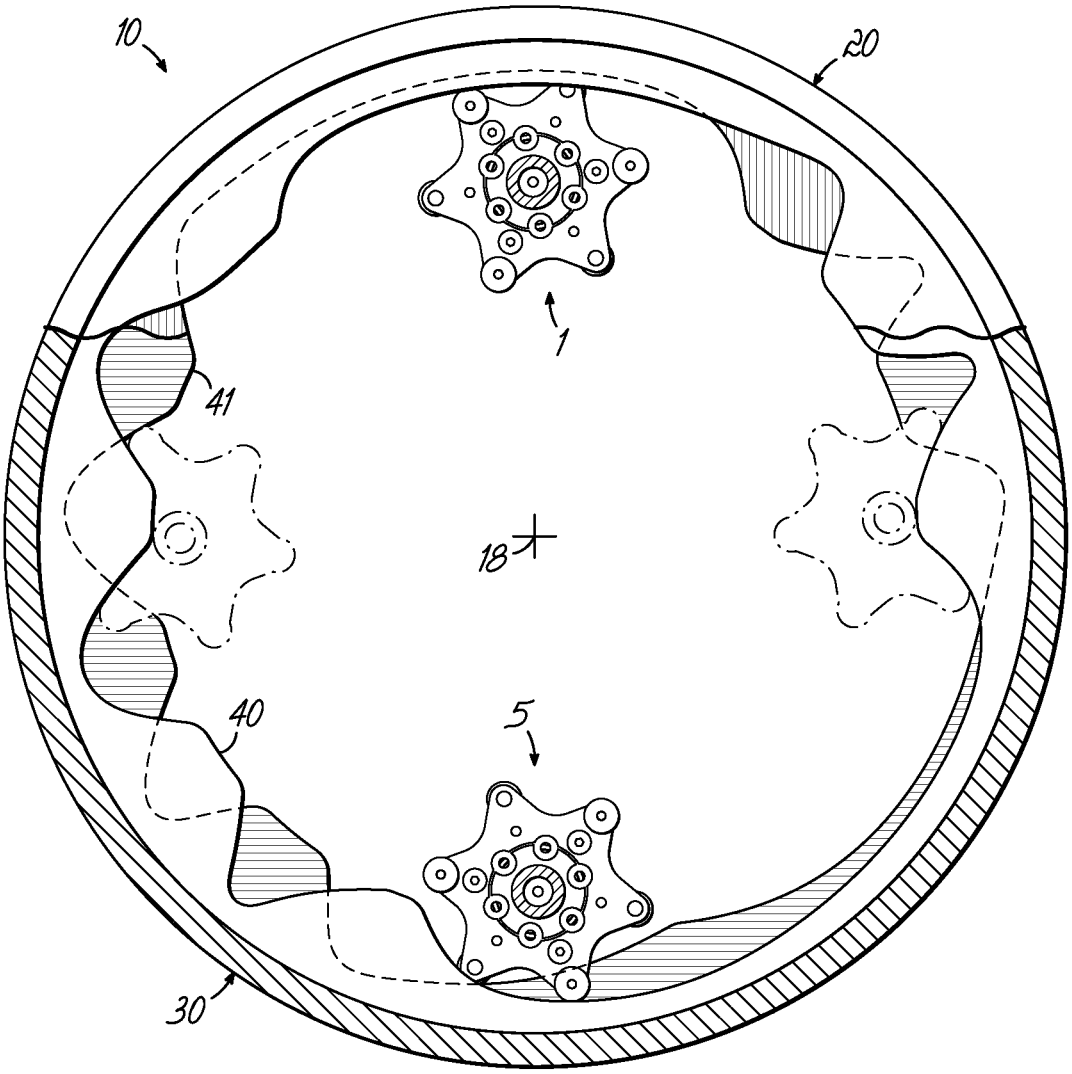
FIG. 10 is an illustrative elevational view in partial cross-section of the cams of the invention, correlating to FIG. 7, also in partial cross-section, and illustrating one lower planetary member in operative engagement with a second one of the cams and the upper planetary member operatively engaging a first one of the cams.
Figure 11:
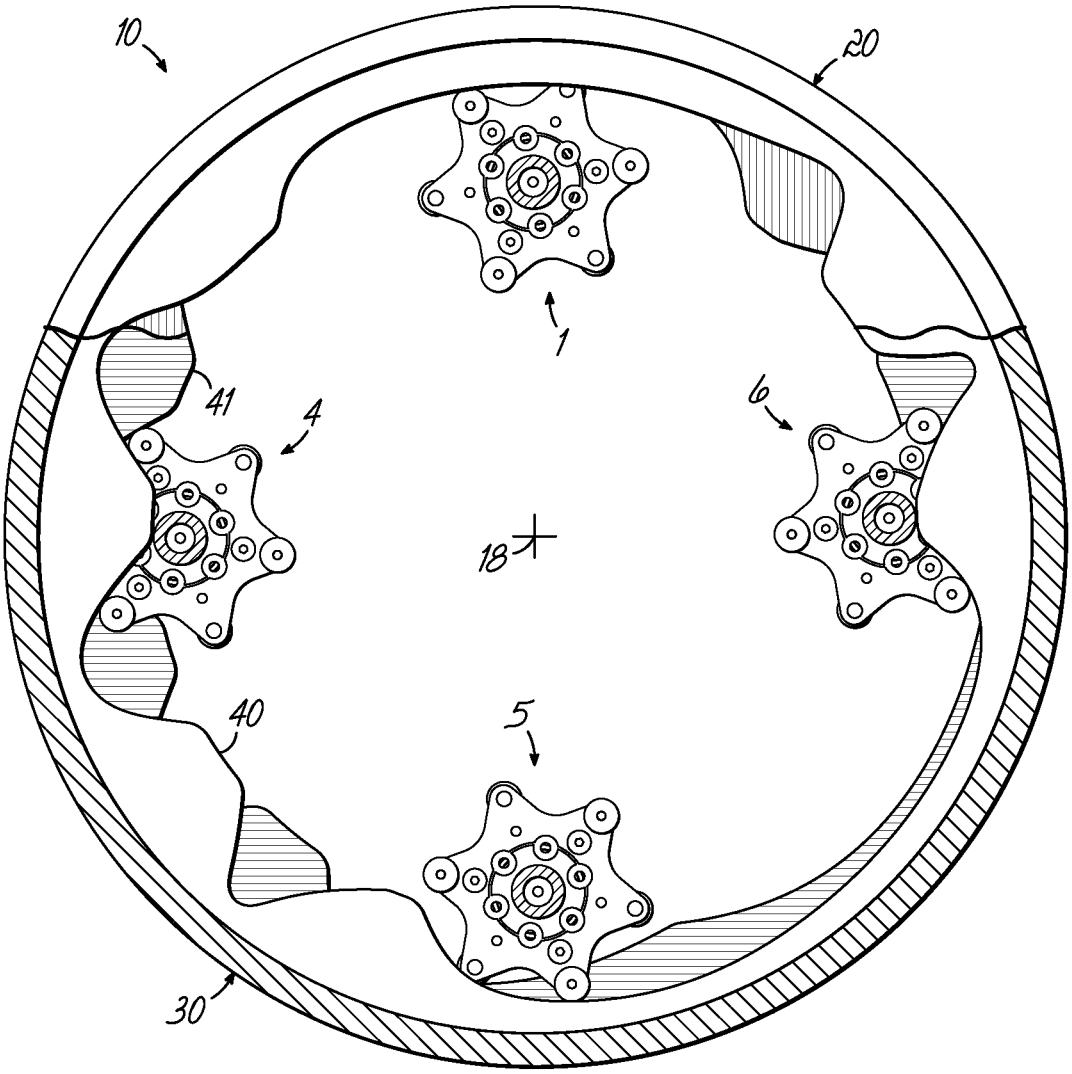
FIG. 11 is an illustrative elevational view in partial cross-section of the feeder of the invention correlating to FIG. 8 illustrating four planetary members with the lower 3 planetary members operatively engaging a second one of the cams and the upper planetary member operatively engaging a first one of the cams.
Figure 12:
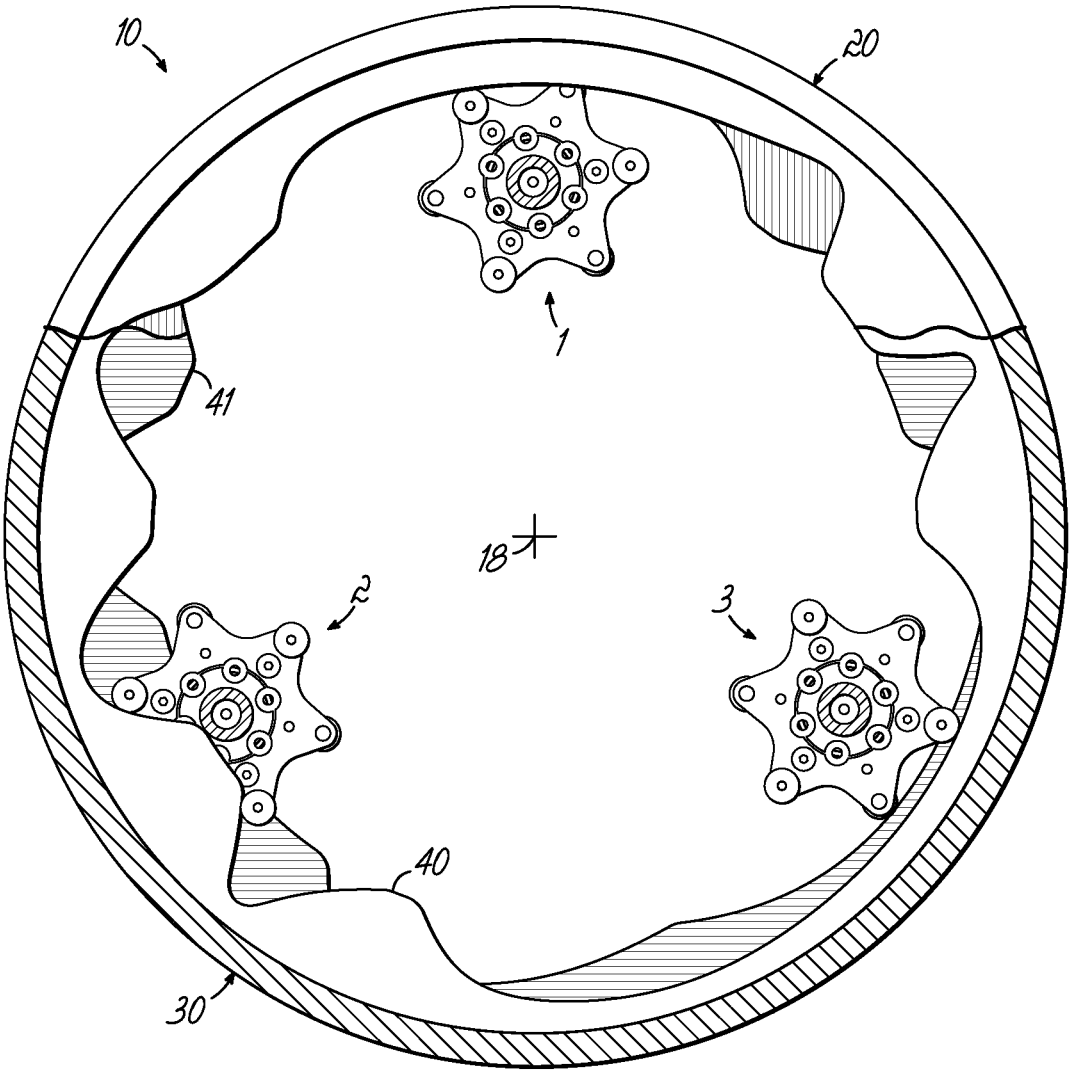
FIG. 12 is an illustrative elevational view in partial cross section of the feeder of the invention, correlating to FIG. 9, illustrating three planetary members operatively engaging the first one of the cams.
Figure 13:
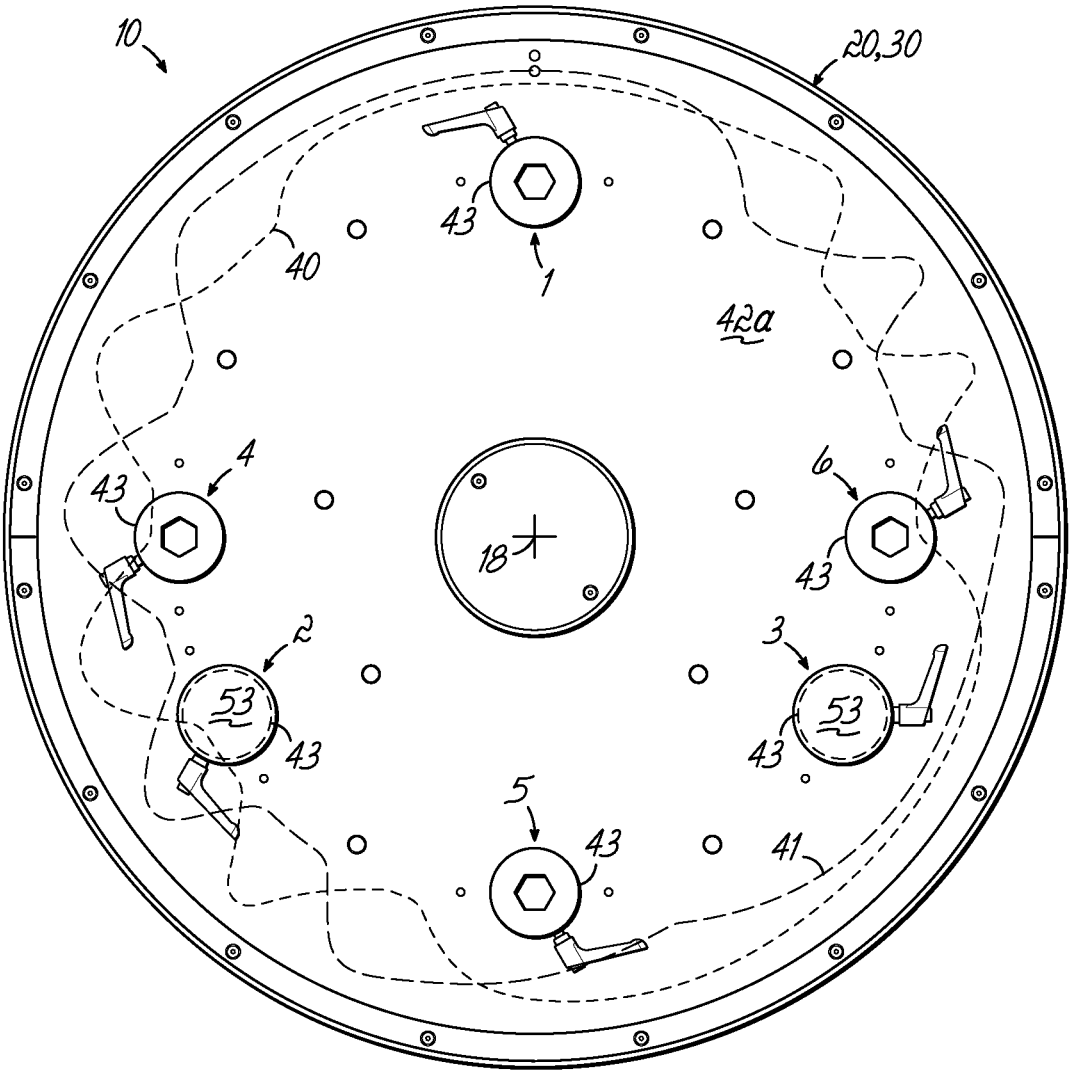
FIG. 13 is a diagrammatic elevational view similar to FIG. 8 showing 4 planetary members for receiving respective spindle assemblies and also illustrating, in dashed or hidden lines, respective cam surfaces of the cams.
Figure 14:
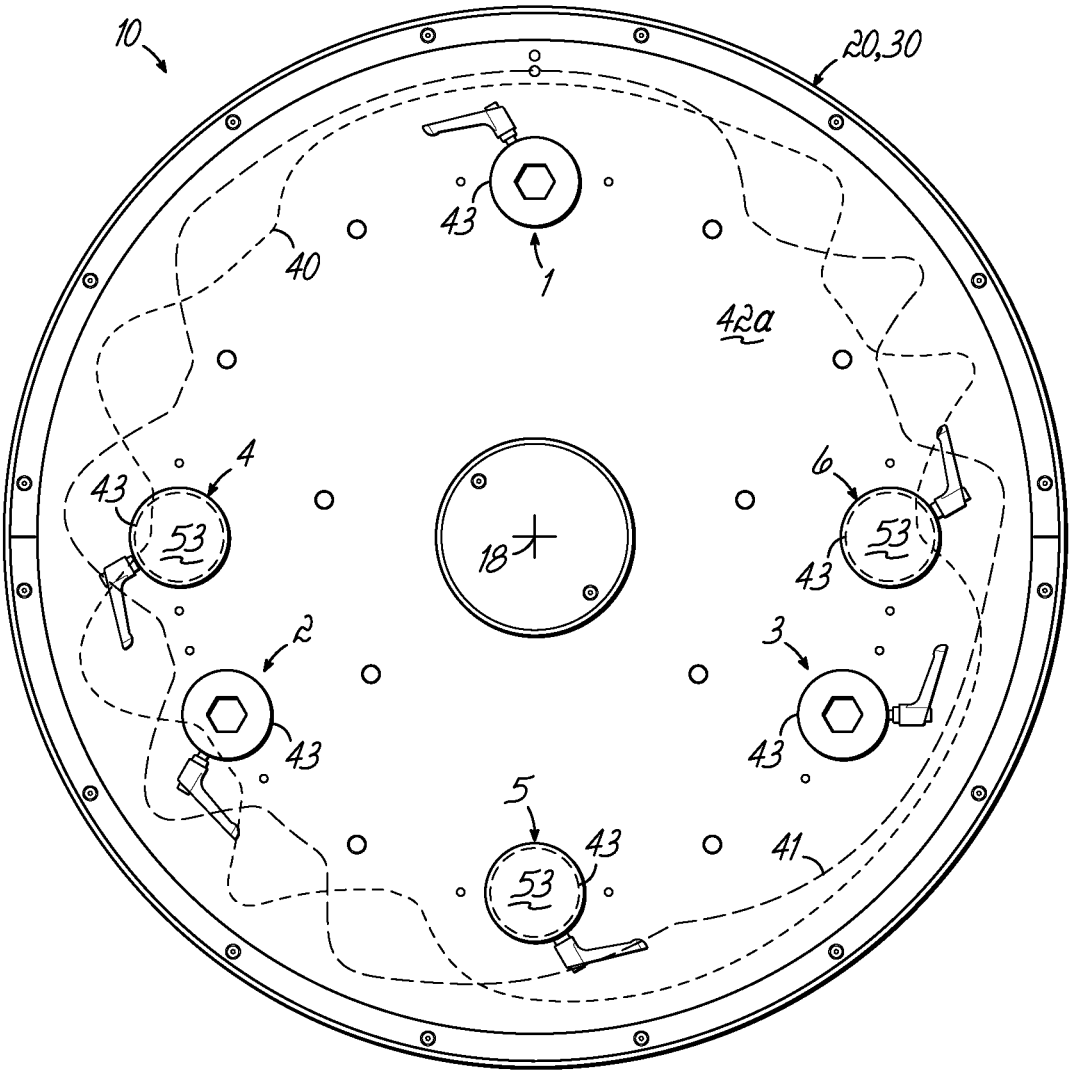
FIG. 14 is a diagrammatic elevational end view similar to FIG. 9 showing 3 planetary members at 120° angular spacing for receiving respective selected spindle assemblies and also illustrating, in dashed or hidden lines, respective cam surface of the cams.
Figure 15:
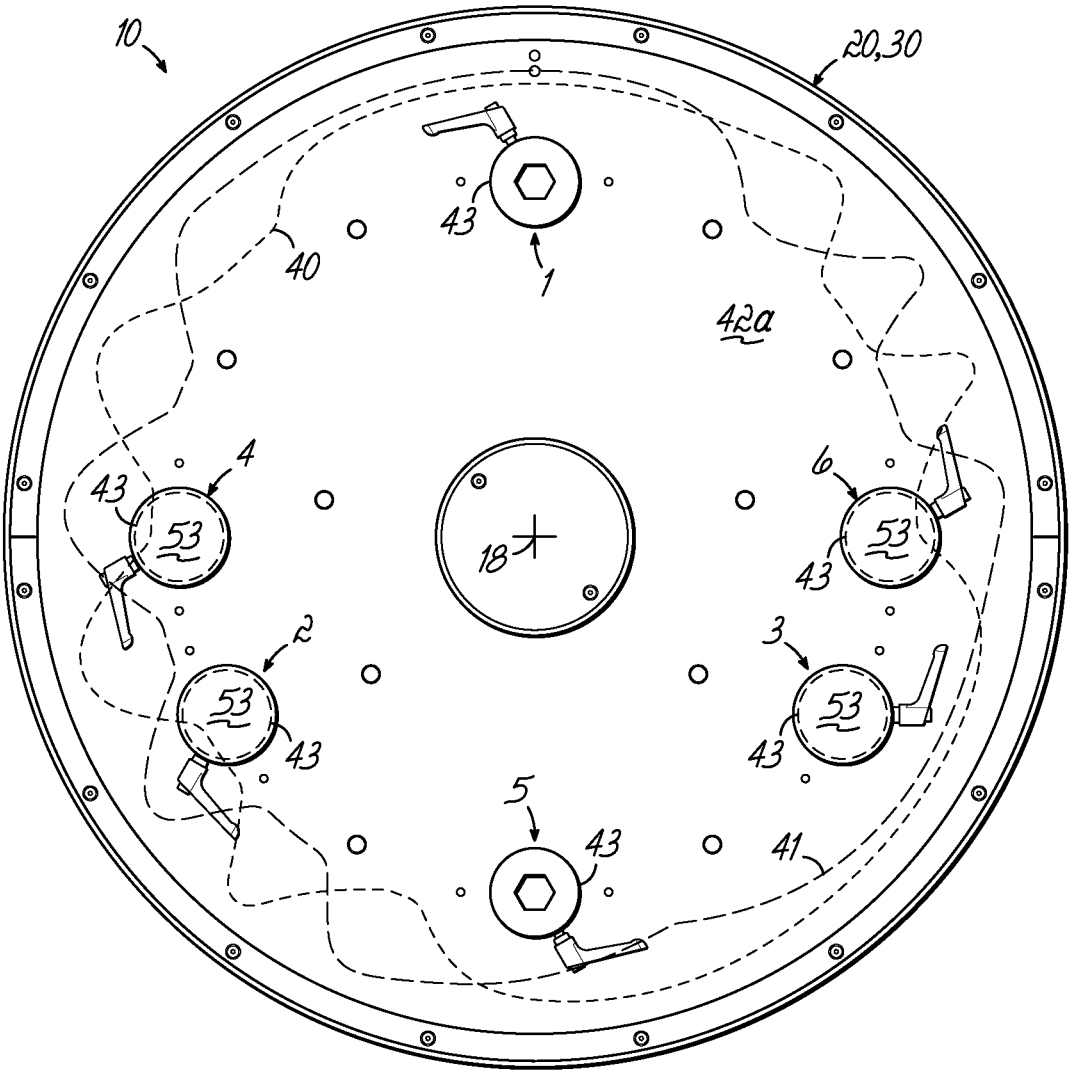
FIG. 15 is a diagrammatic elevational end view of the invention similar to FIG. 7 showing two selected planetary member positions at 180° angular spacing for receiving two respective selected spindle assemblies and also illustrating, in dashed of hidden lines, respective cam surfaces of the cams.
Figure 16A:
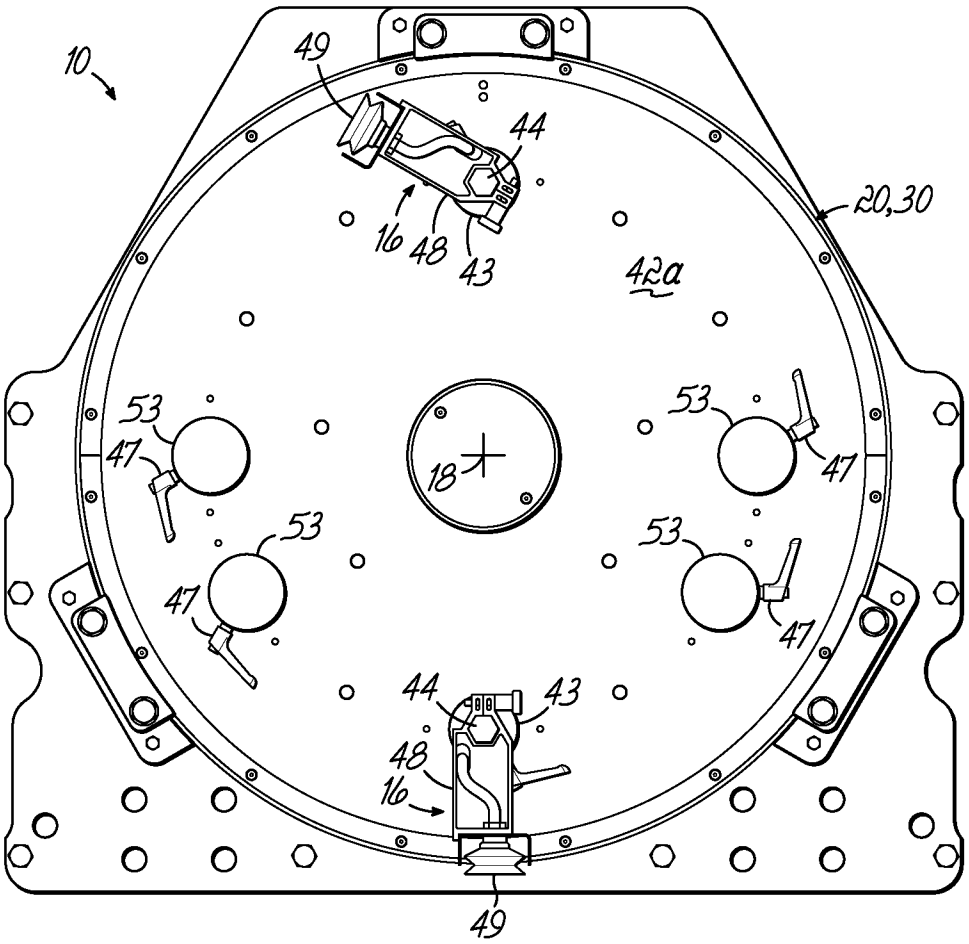
FIG. 16A is a diagrammatic end view corresponding to FIGS. 7, 10 and 15, illustrating two spindles selectively mounted to planetary members angularly spaced at 180° on the feeder.
Figure 16B:
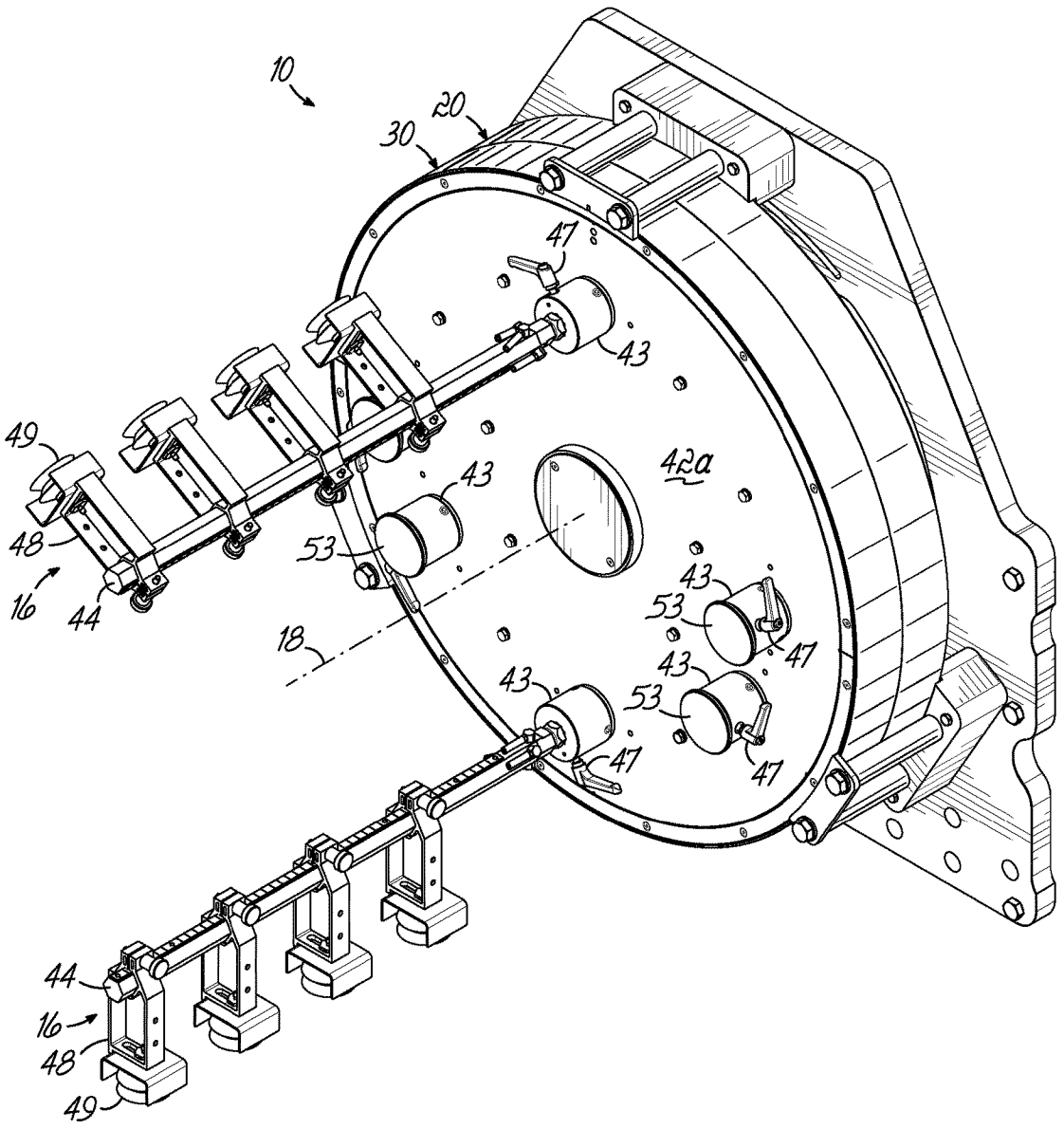
FIG. 16B is a diagrammatic isomeric view of the invention as in FIG. 16A, illustrating two selected spindle assemblies.
Figure 17A:
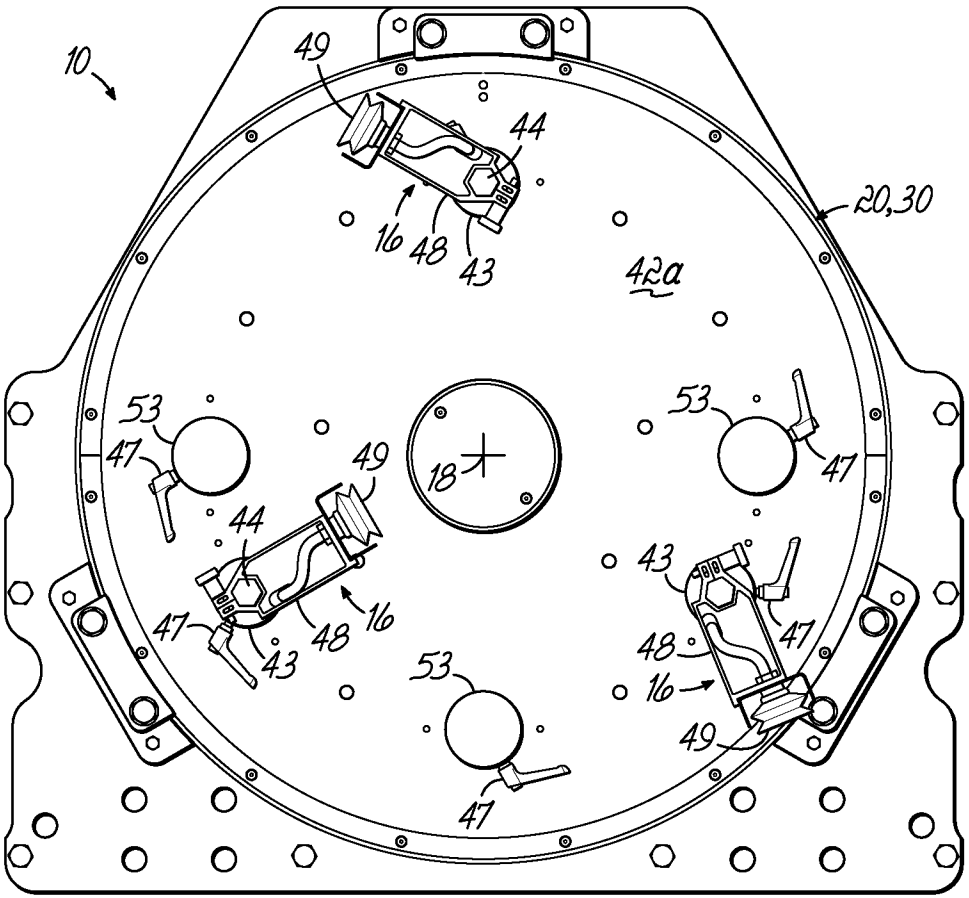
FIG. 17A is a diagrammatic end view corresponding to FIGS. 9, 12 and 14, Illustrating three spindles selectivity mounted to planetary members angularly spaced at 120° on the feeder.
Figure 17B:
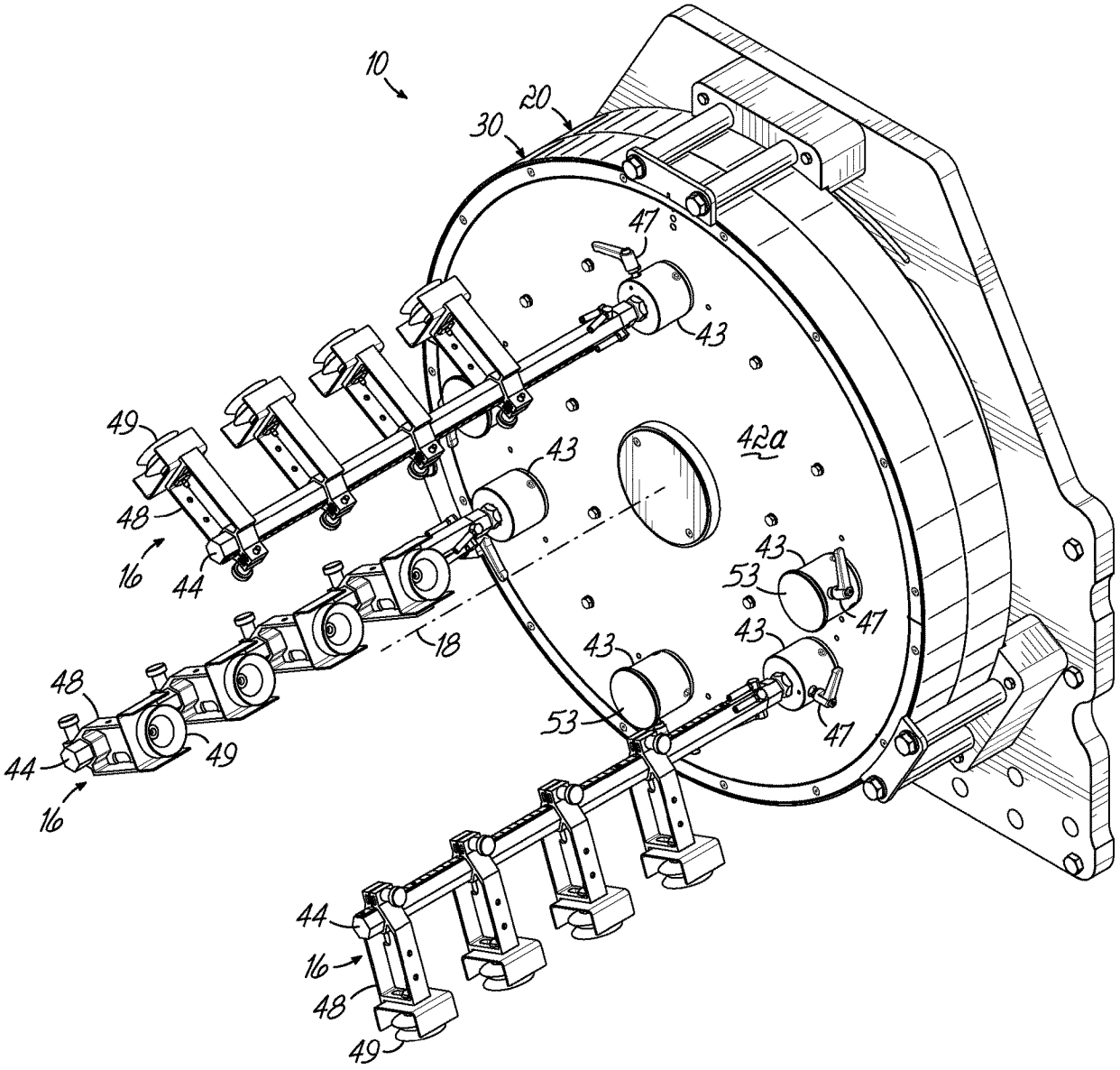
FIG. 17B is a diagrammatic isometric view of the invention as in FIG. 17A, illustrating three selected spindle assembles.
Figure 18A:
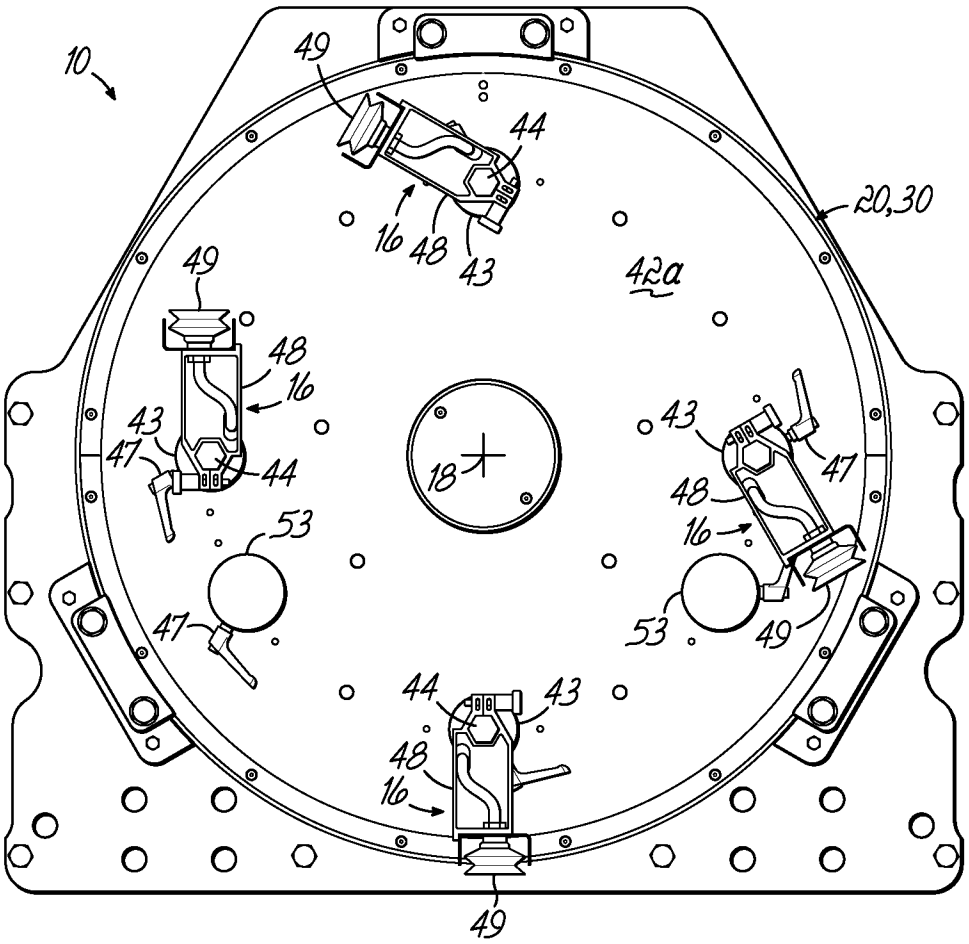
FIG. 18A is a diagrammatic end view corresponding to FIGS. 8, 11, and 13, illustrating four spindles selectively mounted to planetary members angularly spaced at 90° on the feeder.
Figure 18B:
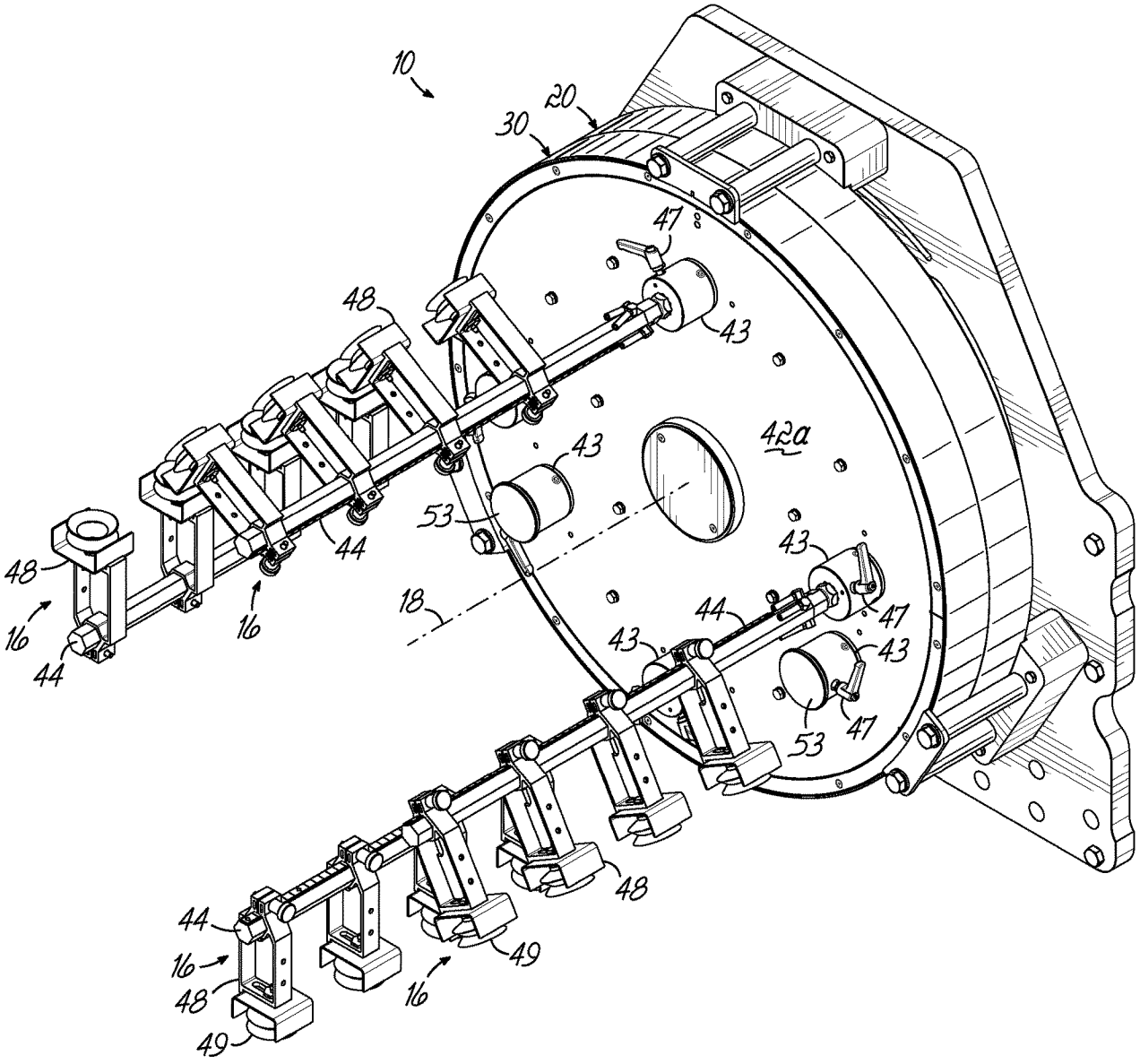
FIG. 18B is a diagrammatic isometric view of the invention as in FIG. 18A, illustrating four selected spindle assemblies.

With reference to the overall features of the invention, note FIG. 1 illustrates diagrammatically capped planetary members 2, 3, 4 and 6. There is one selected spindle with arms 48 selectively mounted on a planetary member 1, and one on planetary member 5 (see FIGS. 5, 7, 10).

Alternatively, it will be appreciated the Figures of the drawings diagrammatically illustrate a feeder 10A (FIGS. 16A, 16B); a feeder 10B (FIGS. 17A, 17B); and a feeder 10C (FIGS. 18A, 18B), each varying from the other by the selective addition or removal of spindle assemblies 16 to or from respective ones of the planetary members 1-6.

Figure 6:
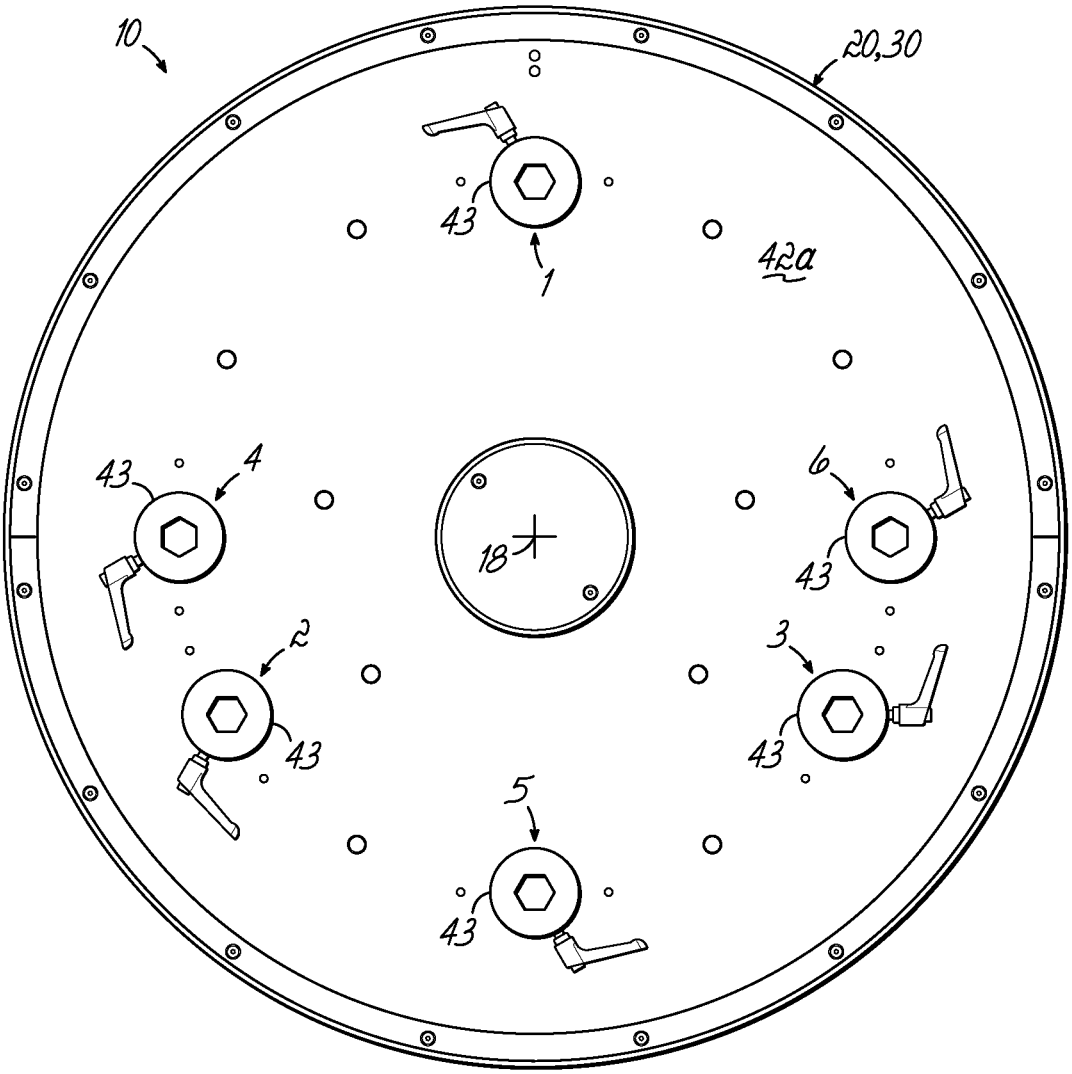
FIG. 6 is a diagrammatic elevational view of the invention illustrating angular spacing positions of six planetary members for selective receipt of selected spindle shafts.

So in FIG. 6, an end view of feeder 10 illustrates diagrammatically the total plurality of planetary members 1-6 ready for selective mounting of spindle assemblies thereon. In FIG. 6, the respective angular spacing of the planetary members 1-6 are illustrated and are also enumerated by the collars 43 on each. Other Figures omit the detail number 43 for the collars (See FIGS. 19A-19C).

Figure 7:
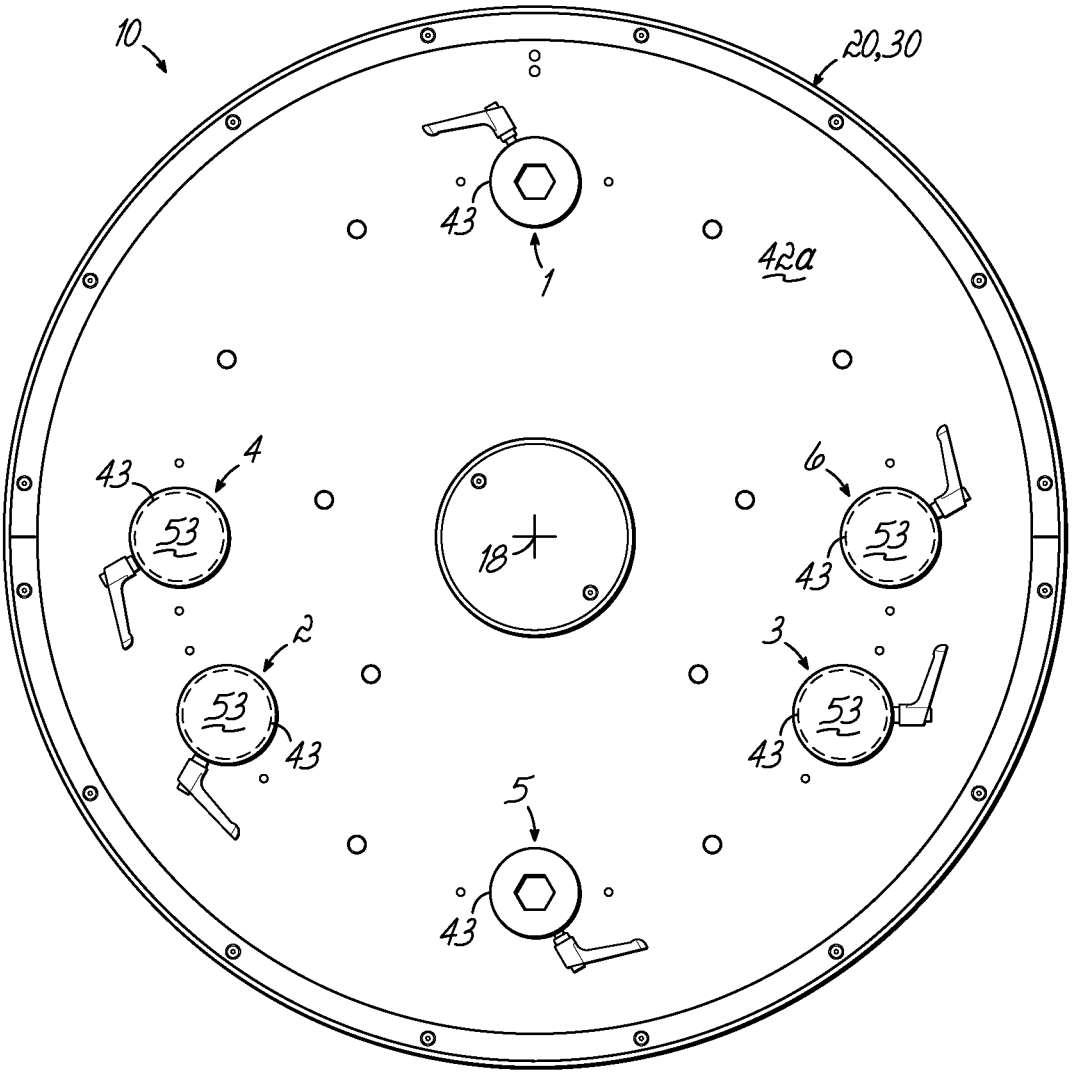
FIG. 7 is a diagrammatic elevational view as in FIG. 6 but illustrating 2 selected planet members at 180° angular spacing for receiving two respective selected spindle assemblies, and 4 other planet members capped in inoperative mode; and without spindles.

In FIG. 7, planetary members 1 and 5 are ready for selected spindle assemblies 16 while members 2, 3, 4 and 6 are capped by caps 53. (See FIGS. 10, 15, 16A, 16B).

In FIG. 8, planetary members 1, 4, 5 and 6 are illustrated ready to selectively receive spindle assemblies 16 while planetary members 2 and 3 are capped at 53. (See FIGS. 11, 13, 18A, 18B). This provides selection of four planetary members, with spindles.

In FIG. 9, planetary members 1, 2 and 3 are illustrated ready to selectively receive spindle assemblies 16 while planetary members 4, 5 and 6 are capped at 53. (See FIGS. 12, 14, 17A, 17B). This provides selection of three planetary members, with spindles.

Accordingly, it will be appreciated in one embodiment of the invention that a feeder 10 is selectively configured to provide multiple spindle assemblies for transporting either one, two, three or four blanks per cycle or revolution of the planetary members 1-6 about axis 18. A first set of planetary members is operatively engaged by a first cam while a second set is operatively engaged by an adjacent cam, all within the confines of the single feeder with desired throughput of blanks of a variety of sizes.

It will be appreciated each cycle or revolution of the feeder 10 includes one full revolution of a planetary member about axis 18.

Stated more generally, a rotary blank feeder is selectively configurable to pick and place one, two, three of four carton blanks for each cycle or revolution of the feeder by virtue of driving two sets of planetary members by multiple spaced respective cams and selectively applying spindle assemblies to selected planetary members. Of course, such a feeder may be provided with multiple cams greater than two in number and/or with more or less number of planetary members.

Thus chargeover of the feeder to handle various size carton blanks is expedited by removing and mounting selected spindle assemblies.

Preferably, blanks are picked, moved through a portion of a four cusp path from a pick station to a place station, the path portion lying between a pick cusp and an extended place cusp.

In a preferred method according to the invention, distinct sets of planetary members in a rotary blank feeder are operatively associated with respective ones of multiple cams which rotate the respective planetary members as they are moved around a circular path, and selected spindle members rotating with planetary members on which they are mounted move the blanks through a portion of four cusp path from a pick station at relatively zero velocity to a place station at a greater velocity.

Components and features of the invention as described herein may be modified or combined with or without other components as described without departing from the scope of the invention.

In that regard, it will be appreciated that the cams, cam surfaces, planetary members, spindle assemblies, functions and other features of the invention are shown diagrammatically herein for clarity and illustrative purposes without limitation.

Two or more cams, with associated planetary members and selected spindle members could be used in a variety of combinations.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used as described or in any combination with other features. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept and from the claims.

What is claimed is:

1. A rotary feeder for feeding items (B) from a first position to a second position, comprising:

a first sun member provided with a pair of first outer ring surfaces;

a second sun member provided with a pair of second outer ring surfaces, said pair of first and pair of second outer ring surfaces being axially displaced from each other, respectively, along a central axis of rotation, said first sun member and second sun member being coaxially mounted about, and axially displaced along, said central axis of rotation;

one or more first planetary members in operative engagement with only said pair of first outer ring surfaces and one or more second planetary members in operative engagement with only said pair of second outer ring surfaces, each of said one or more first planetary members and one or more second planetary members being configured to rotate about a different and separate planetary axis of rotation parallel to said central axis of rotation;

a first set of spindle assemblies configured to be selectively mountable on first planetary members of only said one or more first planetary members and a second set of spindle assemblies configured to be selectively mountable on second planetary members of only said one or more second planetary members, wherein the mounted spindle assemblies of said first set and second set are located at different and separate positions angularly spaced about said central axis of rotation in order to be coupled with at least a portion of said items (B).

2. The rotary feeder according to claim 1, wherein the planetary axes of rotation of said one or more first planetary members and the planetary axes of rotation of said one or more second planetary members are disposed about said central axis of rotation according to a respective first geometric configuration and second geometric configuration, said first geometric configuration being geometrically different from said second geometric configuration.

3. The rotary feeder according to claim 1, wherein said first outer ring surfaces have a shape that is same as a shape of said second outer ring surfaces.

4. The rotary feeder according to claim 1, wherein a combined number of said mounted spindle assemblies is selectable among one, two, three, four or six.

5. The rotary feeder according to claim 4, wherein, when said combined number is two, the mounted spindle assemblies are angularly spaced 180° apart about said central axis of rotation, and when said combined number is four, the mounted spindle assemblies are angularly spaced 90° apart about said central axis of rotation.

6. The rotary feeder according to claim 4, wherein, when said combined number is two, a first mounted spindle assembly is part of said first set and a second mounted spindle assembly is part of said second set, and when said combined number is four, a first mounted spindle assembly is part of said first set and a second, a third and a fourth mounted spindle assemblies are part of said second set.

7. The rotary feeder according to claim 4, wherein, when said combined number is three, the mounted spindle assemblies are angularly spaced 120° apart about said central axis of rotation, and when said combined number is six, the mounted spindle assemblies are angularly spaced 60° apart about said central axis of rotation.

8. The rotary feeder according to claim 4, wherein, when said combined number is three, the mounted spindle assemblies are all part of said first set.

9. The rotary feeder according to claim 1, wherein each spindle assembly of said first set and second set comprises a holding member configured to pick-up said objects (B) at said first position and off-load said objects (B) at said second position, thus forming a plurality of holding members.

10. The rotary feeder according to claim 9, wherein said holding members are configured to traverse an enclosed path (P) having four cusps, said first position being located at a pick cusp of said cusps.

11. The rotary feeder according to claim 1, wherein said one or more first planetary members and said one or more second planetary members consist of three planetary members each.

12. The rotary feeder according to claim 1, further including a vacuum supply configured to be operably connected to each spindle assembly of said first set and second set through a respective planetary member on which the spindle assembly is selectively mountable.

13. The rotary feeder according to claim 12, further including means for blocking said vacuum supply to a planetary member on which no spindle assembly is mounted.

14. The rotary feeder according to claim 1, wherein said planetary axes of rotation are configured to move in a circular path about said central axis of rotation.

15. A method for operating a rotary feeder for feeding items (B) from a first position to a second position, comprising the following steps:

providing a first sun member and a second sun member each having a pair of first and a pair of second outer ring surfaces, respectively, said pair of first and pair of second outer ring surfaces being axially displaced from each other, respectively, along a central axis of rotation, and said first sun member and second sun member being axially displaced from each other along the central axis of rotation;

operatively engaging one or more first planetary members and one or more second planetary members with only said pair of first outer ring surfaces and only said pair of second outer ring surfaces, respectively, wherein each of said one or more first planetary members and one or more second planetary members are configured to rotate about a different and separate planetary axis of rotation parallel to said central axis of rotation;

selectively mounting spindle assemblies on respective planetary members of only said one or more first planetary members and only one or more second planetary members; and rotating the mounted spindle assemblies about said axes of rotation at different and separate positions angularly spaced about said central axis of rotation to couple the mounted spindle assemblies with at least a portion of said items (B).

16. The method according to claim 15, further comprising the step of releasably mounting a combined number of one or two or three or four or six spindle assemblies.

17. The method according to claim 15, further comprising the step of releasably mounting a combined number of two or four spindle assemblies on respective planetary members, said spindle assemblies being disposed about said central axis of rotation at 90° or 180° apart respectively.

18. The method according to claim 15, further comprising the step of releasably mounting a combined number of three spindle assemblies on respective planetary members, said spindle assemblies being disposed about said central axis of rotation at 120° apart.

19. The method according to claim 15, further comprising the steps of providing said spindle assemblies with respective holding members, picking-up said objects (B) at said first position and off-loading said objects (B) at said second position by said holding members.

20. The method according to claim 19, further comprising the step of moving said holding members along an enclosed path (P) having four cusps, said first position being located at a pick cusp of said cusps.

21. The method according to claim 15, further comprising the step of selecting a combined number of spindles assemblies according to at least one size of the items (B) to feed.

22. A method for feeding items (B) from a first position to a second position, comprising the following steps:

coupling a first number of item-holding spindle assemblies only to respective first planetary members of only a first sun member of a feeder, and a second number of item-holding spindle assemblies only to respective second planetary members of only a second sun member of the feeder, wherein the first sun member and the second sun member are coaxially mounted about and axially displaced along a central axis of rotation, each of said first planetary members and second planetary members is rotatable about a different and separate planetary axis of rotation, and the mounted spindle assemblies of said first set and second set are located at a combined number of different and separate positions angularly spaced about said central axis of rotation, said combined number resulting as the sum of said first number and second number of item-holding spindle assemblies; and feeding the items (B) through the item-holding spindles from said first position to said second position.

23. A rotary carton feeder for feeding carton blanks (B) from a carton magazine to a carton conveyor, said feeder comprising:

a plurality of cams, each cam having cam surfaces in angular phase with those cam surfaces of another cam;

said cams of said plurality coaxially mounted about a central axis with said cam surfaces of one cam oriented in the same angular phase with respect to the cam surfaces of said another cam about said central axis;

said cams spaced axially along said central axis one from the other, and a plurality of rotatable planetary members;

a first set of planetary members of said plurality respectively mounted in operative engagement with only a first cam of said cams and a second set of planetary members of said plurality in operative engagement with only a second cam of said cams;

respective carton holding spindle assemblies being selectively mountable on and removeable from only respective ones of said first set of rotatable planetary members and only respective ones of said second set of rotatable planetary members;

said rotatable planetary members being respectively moveable in a circular path about said central axis while in respective operative engagement with one of said cams for rotation about a respective planetary axis of rotation.

24. The feeder according to claim 23 including an operable carton holding member on each spindle assembly for holding and transporting carton blanks (B) from said carton magazine, said carton holding members traversing a path of travel comprising an enclosed path (P) having four cusps.

25. The feeder according to claim 23 wherein respective rotatable planetary members are moveable in a circular path about said central axis and in operable engagement with a respective cam for rotating said rotatable planetary members about respective planetary axes of rotation parallel to said central axis.

26. The feeder according to claim 23 wherein said spindle assemblies are selectively mountable on and removeable from selected planetary members on planetary axes of rotation of said planetary members.

27. The feeder according to claim 23 wherein said carton holding spindle assemblies are selectively mountable in total number of 1, 2, 4 or 3.

28. The feeder according to claim 27 wherein when said total number is 2 or 4, there are only 2 or 4 total spindle assemblies, respectively on said feeder, and wherein said rotatable planetary members with spindle assemblies thereon are disposed about said central axis at one of 90° or 180° apart.

29. The feeder according to claim 27 wherein when said total number is 3, there are only 3 spindle assemblies on said feeder, and wherein said rotatable planetary members with spindle assemblies thereon are disposed about said central axis at 120° apart.

30. The feeder according to claim 24 including in combination therewith a carton conveyor and wherein one cusp of said cusps has a component of motion in a machine direction (MD) of said carton conveyor.

31. The feeder according to claim 23 further including a respective vacuum supply operably connected to each of said spindle assemblies through respective rotatable planetary members on which they are mounted; and means for blocking said respective vacuum supply of respective rotatable planetary members when no spindle assemblies are mounted thereon.

32. The feeder according to claim 23 including six rotatable planetary members.

33. The feeder according to claim 23 wherein said spindle assemblies are selectively mountable on selected planetary members for rotation about said planetary axes of rotation.

34. The feeder according to claim 32 wherein three rotatable planetary members of said six rotatable planetary members are operably connected to said first cam and remaining three rotatable planetary members of said six rotatable planetary members are operatively connected to said second cam.

35. The feeder according to claim 23, further including one of 1, 2, 4 or 3 of said spindle assemblies.

36. The feeder according to claim 35 wherein when 3 planetary members are selected, one of said spindle assemblies is mounted on each of said 3 rotatable planetary members in operative engagement with said first cam.

37. The feeder according to claim 35 wherein when 2 or 4 planetary members are selected, one of said spindle assemblies is mounted on a rotatable planetary member in operative engagement with said first cam and other spindle assemblies are mounted on rotatable planetary members in operative engagement with said second cam.

38. The feeder according to claim 35 wherein said first cam is operably connected to rotate one rotatable planetary member of said first set with an associated spindle assembly thereon and said second cam is operable connected to rotate three rotatable planetary members of said second set with operable spindle assemblies thereon, when a total of four spindle assemblies are selected, with said one planetary member and said three planetary members rotated together by said respective cams to pick and place four carton blanks (B) in a single rotation of said planetary members about said central axis.

39. The feeder according to claim 23 wherein said cams are identical.

40. A rotary feeder of the type having a first sun ring, a first set of rotatable planetary members in operative engagement with only said first sun ring, and item-holding spindles selectively mountable on and removeable from selected planetary members of only said first set, the rotary feeder further comprising:

a second sun ring in angular phase with said first sun ring, about a central axis;

a second set of rotatable planetary members in operative engagement with only said second sun ring;

said first and second sets of rotatable planetary members moveable in circular paths about said central axis; and respective spindles being mountable on and removeable from selected ones of said second set of rotatable planetary members.

41. The rotary feeder according to claim 40 wherein the number of planetary members of said first and second sets is selectable and including one of 1, 2, 4 or 3 total planetary members.

42. The rotary feeder according to claim 41 wherein, when the total number of selected planetary members of said second set is one or three, only one planetary member of said first set is selected.

43. The rotary feeder according to claim 41 wherein, when the total number of selected planetary members of said first set is three, three planetary members in operative engagement with said first sun ring are selected and no planetary member in operative engagement with said second sun ring is selected.

44. The rotary feeder according to claim 40 wherein the first and second sets of planetary members are carried on respective circular plates rotatable about said central axis.

45. A rotary feeder comprising:

a plurality of guides, each guide having a set of guide surfaces;

a first set of planetary members mounted in operative engagement with a set of said guide surfaces on only a first guide of said plurality of guides;

a second set of planetary members mounted in operative engagement with a set of said guide surfaces on only a second guide of said plurality of guides;

said guides oriented in respective planes, coaxially mounted about said central axis, and axially spaced along said central axis; and respective spindles removably mountable on only respective ones of said first set of planetary members and only respective ones of said second set of planetary members.

46. The rotary feeder according to claim 45 wherein said sets of guide surface are identical.

47. A rotary blank feeder comprising:

a plurality of rotatable members mounted for respective rotation about a central axis in a circular path, a plurality of blank holding spindles, selected ones of which are individually mounted on and removeable from selected ones of said rotatable members;

said rotatable members with spindles thereon being alternately selectable for feeding, in the alternative, one, two, three or four blanks (B) for each revolution of the rotatable members about said central axis; and wherein spindles are removed from non-selected rotatable members.

48. A method for picking carton blanks (B) from a pick station proximate a carton magazine and placing picked blanks (B) in a place station, the method accommodating a variety of blank sizes and including the steps of:

picking and placing carton blanks (B) with a rotary feeder having a plurality of carton holding spindles mounted respectively on rotatable planetary members, in turn mounted for respective motion in a circular path about a central axis and in operative engagement respectively with only one or another of two respective circular cam rings;

selecting the total number of spindles from one of one, two or four spindles; and alternatively selecting the total number of three spindles on rotatable planetary members in operative engagement with only one of said circular cam rings.

49. The method according to claim 48 including, when two or four spindles are selected, the further step of operatively engaging one rotatable planetary member with one of said cam rings and one rotatable planetary member with another of said cam rings.

50. The method according to claim 48 including the further step of operatively engaging one rotatable planetary member with a first cam ring and three rotatable members with a second cam of said cam rings when four spindles are selected.

51. The method according to claim 48 including, when three spindles are selected, the step of engaging said three planetary members with a first cam ring of said cam rings and removing spindles from all other planetary members operatively associated with a second cam ring of said cam rings.

52. The method according to claim 48 including the steps of supplying carton holding vacuum through selected spindles and blocking vacuum from non-selected spindles.

53. The method according to claim 48 wherein said spindles include ends for grasping and holding carton blanks (B), and the step of moving said ends through an enclosed path (P) having four cusps, one of which is elongated in a machine direction (MD).

* * * * *